US010415376B2

(12) United States Patent
Song et al.

(10) Patent No.: US 10,415,376 B2
(45) Date of Patent: Sep. 17, 2019

(54) DUAL TRANSDUCER COMMUNICATIONS NODE FOR DOWNHOLE ACOUSTIC WIRELESS NETWORKS AND METHOD EMPLOYING SAME

(71) Applicants: Limin Song, West Windsor, NJ (US); Yibing Zhang, Annandale, NJ (US); Katie M. Walker, Milford, NJ (US); Henry Alan Wolf, Morris Plains, NJ (US)

(72) Inventors: Limin Song, West Windsor, NJ (US); Yibing Zhang, Annandale, NJ (US); Katie M. Walker, Milford, NJ (US); Henry Alan Wolf, Morris Plains, NJ (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 15/666,292

(22) Filed: Aug. 1, 2017

(65) Prior Publication Data

US 2018/0058207 A1 Mar. 1, 2018

Related U.S. Application Data

(60) Provisional application No. 62/433,491, filed on Dec. 13, 2016, provisional application No. 62/428,425,
(Continued)

(51) Int. Cl.

| | |
|---|---|
| ***E21B 47/16*** | (2006.01) |
| ***E21B 47/00*** | (2012.01) |
| *E21B 47/01* | (2012.01) |

(52) U.S. Cl.
CPC ..... *E21B 47/16* (2013.01); *E21B 47/0005* (2013.01); *E21B 47/011* (2013.01)

(58) Field of Classification Search
CPC ..... E21B 47/16; E21B 47/0005; E21B 47/011
See application file for complete search history.

(56) References Cited

U.S. PATENT DOCUMENTS

| | | | |
|---|---|---|---|
| 3,103,643 A | 6/1960 | Kalbfell | 340/17 |
| 3,205,477 A | 9/1965 | Kalbfell | 340/18 |

(Continued)

FOREIGN PATENT DOCUMENTS

| | | | |
|---|---|---|---|
| CN | 102 733 799 B | 6/2014 | |
| CN | 102733799 | 6/2014 | E21B 47/16 |

(Continued)

OTHER PUBLICATIONS

U.S. Appl. No. 15/666,334, filed Aug. 1, 2017, Walker, Katie M. et al.

(Continued)

*Primary Examiner* — Ryan W Sherwin
(74) *Attorney, Agent, or Firm* — ExxonMobil Upstream Research Company—Law Department

(57) ABSTRACT

An electro-acoustic communications node system and method for downhole wireless telemetry, the system including a housing for mounting to or with a tubular body; a receiver transducer positioned within the housing, the receiver transducer structured and arranged to receive acoustic waves that propagate through the tubular member; a transmitter transducer and a processor, positioned within the housing and arranged to retransmit the acoustic waves to another acoustic receiver in a different housing, using the tubular member for the acoustic telemetry. In some embodiments, the transducers may be piezoelectric transducers and/or magnetostrictive transducers. Included in the housing is also a power source comprising one or more batteries. A downhole wireless telemetry system and a method of monitoring a hydrocarbon well are also provided.

28 Claims, 13 Drawing Sheets

Related U.S. Application Data filed on Nov. 30, 2016, provisional application No. 62/428,385, filed on Nov. 30, 2016, provisional application No. 62/428,374, filed on Nov. 30, 2016, provisional application No. 62/428,394, filed on Nov. 30, 2016, provisional application No. 62/428,367, filed on Nov. 30, 2016, provisional application No. 62/381,330, filed on Aug. 30, 2016.

(56) References Cited

U.S. PATENT DOCUMENTS

| | | | | |
|---|---|---|---|---|
| 3,512,407 | A | 5/1970 | Zill | 73/152 |
| 3,637,010 | A | 1/1972 | Malay et al. | 166/51 |
| 3,741,301 | A | 6/1973 | Malay et al. | 166/191 |
| 3,781,783 | A | 12/1973 | Tucker | 340/18 |
| 3,790,930 | A | 2/1974 | Lamel et al. | 340/18 |
| 3,900,827 | A | 8/1975 | Lamel et al. | 340/18 |
| 3,906,434 | A | 9/1975 | Lamel et al. | 340/18 |
| 4,001,773 | A | 1/1977 | Lamel et al. | 340/18 |
| 4,283,780 | A | 8/1981 | Nardi | 367/82 |
| 4,298,970 | A | 11/1981 | Shawhan et al. | 367/82 |
| 4,302,826 | A | 11/1981 | Kent et al. | 367/82 |
| 4,314,365 | A | 2/1982 | Peterson et al. | 367/82 |
| 4,884,071 | A | 11/1989 | Howard | 340/854 |
| 4,962,489 | A | 10/1990 | Medlin et al. | 367/32 |
| 5,128,901 | A | 7/1992 | Drumheller | 367/82 |
| 5,136,613 | A | 8/1992 | Dumestre, III | 375/1 |
| 5,166,908 | A | 11/1992 | Montgomery | 367/165 |
| 5,182,946 | A | 2/1993 | Boughner et al. | 73/151 |
| 5,234,055 | A | 8/1993 | Cornette | 166/278 |
| 5,283,768 | A | 2/1994 | Rorden | 367/83 |
| 5,373,481 | A | 12/1994 | Orban et al. | 367/82 |
| 5,468,025 | A | 11/1995 | Adinolfe et al. | 285/114 |
| 5,480,201 | A | 1/1996 | Mercer | 294/67.31 |
| 5,495,230 | A | 2/1996 | Lian | 340/551 |
| 5,562,240 | A | 10/1996 | Campbell | 227/130 |
| 5,592,438 | A | 1/1997 | Rorden et al. | 367/83 |
| 5,667,650 | A | 9/1997 | Face et al. | 204/298.07 |
| 5,850,369 | A | 12/1998 | Rorden et al. | 367/83 |
| 5,857,146 | A | 1/1999 | Kido | 455/38.3 |
| 5,924,499 | A | 7/1999 | Birchak et al. | 175/40 |
| 5,960,883 | A | 10/1999 | Tubel et al. | 166/313 |
| 5,995,449 | A | 11/1999 | Green et al. | 367/83 |
| 6,049,508 | A | 4/2000 | Deflandre | 367/48 |
| 6,429,784 | B1 | 4/2000 | Beique et al. | 340/853.2 |
| 6,125,080 | A | 9/2000 | Sonnenschein et al. | 367/134 |
| 6,128,250 | A | 10/2000 | Reid et al. | 367/153 |
| 6,177,882 | B1 | 1/2001 | Ringgenberg et al. | 340/853.7 |
| 6,236,850 | B1 | 5/2001 | Desai | 455/343 |
| 6,239,690 | B1 | 5/2001 | Burbidge et al. | 340/10.33 |
| 6,300,743 | B1 | 10/2001 | Patino et al. | 320/106 |
| 6,320,820 | B1 | 11/2001 | Gardner et al. | 367/81 |
| 6,324,904 | B1 | 12/2001 | Ishikawa et al. | 73/152.03 |
| 6,360,769 | B1 | 3/2002 | Brisco | 137/268 |
| 6,394,184 | B2 | 5/2002 | Tolman et al. | 166/281 |
| 6,400,646 | B1 | 6/2002 | Shah et al. | 367/82 |
| 6,462,672 | B1 | 10/2002 | Besson | 340/853.2 |
| 6,543,538 | B2 | 4/2003 | Tolman et al. | 166/284 |
| 6,670,880 | B1 | 12/2003 | Hall et al. | 336/132 |
| 6,679,332 | B2 | 1/2004 | Vinegar et al. | 166/373 |
| 6,695,277 | B1 | 2/2004 | Gallis | 241/191 |
| 6,702,019 | B2 | 3/2004 | Dusterhoft et al. | 166/278 |
| 6,717,501 | B2 | 4/2004 | Hall et al. | 336/132 |
| 6,727,827 | B1 | 4/2004 | Edwards et al. | 340/854.9 |
| 6,772,837 | B2 | 8/2004 | Dusterhoft et al. | 166/278 |
| 6,816,082 | B1 | 11/2004 | Laborde | 340/853.3 |
| 6,868,037 | B2 | 3/2005 | Dasgupta et al. | 367/54 |
| 6,880,634 | B2 | 4/2005 | Gardner et al. | 166/250.01 |
| 6,883,608 | B2 | 4/2005 | Parlar et al. | 166/278 |
| 6,899,178 | B2 | 5/2005 | Tubel | 166/313 |
| 6,909,667 | B2 | 6/2005 | Shah et al. | 367/83 |
| 6,912,177 | B2 | 6/2005 | Smith | 367/82 |
| 6,920,085 | B2 | 7/2005 | Finke et al. | 367/83 |
| 6,930,616 | B2 | 8/2005 | Tang et al. | 340/854.4 |
| 6,940,392 | B2 | 9/2005 | Chan et al. | 340/10.4 |
| 6,940,420 | B2 | 9/2005 | Jenkins | 340/855.6 |
| 6,953,094 | B2 | 10/2005 | Ross et al. | 166/381 |
| 6,956,791 | B2 | 10/2005 | Dopf et al. | 367/82 |
| 6,980,929 | B2 | 12/2005 | Aronstam et al. | 702/188 |
| 6,987,463 | B2 | 1/2006 | Beique et al. | 340/856.3 |
| 7,006,918 | B2 | 2/2006 | Economides et al. | 702/1 |
| 7,011,157 | B2 | 3/2006 | Costley et al. | 166/311 |
| 7,036,601 | B2 | 5/2006 | Berg et al. | 166/385 |
| 7,051,812 | B2 | 5/2006 | McKee et al. | 166/305.1 |
| 7,064,676 | B2 | 6/2006 | Hall et al. | 350/853.1 |
| 7,082,993 | B2 | 8/2006 | Ayoub et al. | 166/250.1 |
| 7,090,020 | B2 | 8/2006 | Hill et al. | 166/373 |
| 7,140,434 | B2 | 11/2006 | Chouzenoux et al. | 166/250.11 |
| 7,219,762 | B2 | 5/2007 | James et al. | 181/105 |
| 7,224,288 | B2 | 5/2007 | Hall et al. | 340/853.7 |
| 7,228,902 | B2 | 6/2007 | Oppelt | 166/250.02 |
| 7,249,636 | B2 | 7/2007 | Ohmer | 166/383 |
| 7,252,152 | B2 | 8/2007 | LoGiudice et al. | 166/386 |
| 7,257,050 | B2 | 8/2007 | Stewart et al. | 367/82 |
| 7,261,154 | B2 | 8/2007 | Hall et al. | 166/242.2 |
| 7,261,162 | B2 | 8/2007 | Deans et al. | 166/336 |
| 7,275,597 | B2 | 10/2007 | Hall et al. | 166/297 |
| 7,277,026 | B2 | 10/2007 | Hall et al. | 340/854.8 |
| RE40,032 | E | 1/2008 | van Bokhorst et al. | 455/343.2 |
| 7,317,990 | B2 | 1/2008 | Sinha et al. | 702/6 |
| 7,321,788 | B2 | 1/2008 | Addy et al. | 455/574 |
| 7,322,416 | B2 | 1/2008 | Burris, II et al. | 166/308.1 |
| 7,325,605 | B2 | 2/2008 | Fripp et al. | 166/250.01 |
| 7,339,494 | B2 | 3/2008 | Shah et al. | 340/855.7 |
| 7,348,893 | B2 | 3/2008 | Huang et al. | 340/854.3 |
| 7,385,523 | B2 | 6/2008 | Thomeer et al. | 340/854.8 |
| 7,387,165 | B2 | 6/2008 | Lopez de Cardenas et al. | 166/313 |
| 7,411,517 | B2 | 8/2008 | Flanagan | 340/854.4 |
| 7,477,160 | B2 | 1/2009 | Lemenager et al. | 340/853.1 |
| 7,516,792 | B2 | 4/2009 | Lonnes et al. | 166/308.1 |
| 7,551,057 | B2 | 6/2009 | King et al. | 340/5.72 |
| 7,590,029 | B2 | 9/2009 | Tingley | 367/82 |
| 7,595,737 | B2 | 9/2009 | Fink et al. | 340/854.4 |
| 7,602,668 | B2 | 10/2009 | Liang et al. | 367/25 |
| 7,649,473 | B2 | 1/2010 | Johnson et al. | 340/853.1 |
| 7,750,808 | B2 | 7/2010 | Masino et al. | 340/572.1 |
| 7,775,279 | B2 | 8/2010 | Marya et al. | 166/297 |
| 7,787,327 | B2 | 8/2010 | Tang et al. | 367/27 |
| 7,819,188 | B2 | 10/2010 | Auzerais et al. | 155/250 |
| 7,828,079 | B2 | 11/2010 | Oothoudt | 175/20 |
| 7,831,283 | B2 | 11/2010 | Ogushi et al. | 455/574 |
| 7,913,773 | B2 | 3/2011 | Li et al. | 175/40 |
| 7,952,487 | B2 | 5/2011 | Montebovi | 340/636.1 |
| 7,994,932 | B2 | 8/2011 | Huang et al. | 340/854.3 |
| 8,004,421 | B2 | 8/2011 | Clark | 340/854.4 |
| 8,044,821 | B2 | 10/2011 | Mehta | 340/855.7 |
| 8,049,506 | B2 | 11/2011 | Lazarev | 324/333 |
| 8,115,651 | B2 | 2/2012 | Camwell et al. | 340/853.2 |
| 8,117,907 | B2 | 2/2012 | Han et al. | 73/152.58 |
| 8,157,008 | B2 | 4/2012 | Lilley | 166/253.1 |
| 8,162,050 | B2 | 4/2012 | Roddy et al. | 166/253.1 |
| 8,220,542 | B2 | 7/2012 | Whitsitt et al. | 166/278 |
| 8,237,585 | B2 | 8/2012 | Zimmerman | 340/854.6 |
| 8,242,928 | B2 | 8/2012 | Prammer | 340/853.7 |
| 8,276,674 | B2 | 10/2012 | Lopez de Cardenas et al. | 166/373 |
| 8,284,075 | B2 | 10/2012 | Fincher et al. | 340/854.4 |
| 8,284,947 | B2 | 10/2012 | Giesbrecht et al. | 381/66 |
| 8,316,936 | B2 | 11/2012 | Roddy et al. | 166/253.1 |
| 8,330,617 | B2 | 12/2012 | Chen et al. | 340/854.6 |
| 8,347,982 | B2 | 1/2013 | Hannegan et al. | 175/5 |
| 8,358,220 | B2 | 1/2013 | Savage | 340/853.1 |
| 8,376,065 | B2 | 2/2013 | Teodorescu et al. | 175/40 |
| 8,381,822 | B2 | 2/2013 | Hales et al. | 166/377 |
| 8,388,899 | B2 | 3/2013 | Mitani et al. | 422/179 |
| 8,411,530 | B2 | 4/2013 | Slocum et al. | 367/90 |
| 8,434,354 | B2 | 5/2013 | Crow et al. | 73/152.04 |
| 8,494,070 | B2 | 7/2013 | Luo et al. | 375/262 |
| 8,496,055 | B2 | 7/2013 | Mootoo et al. | 166/278 |
| 8,539,890 | B2 | 9/2013 | Tripp et al. | 109/25 |
| 8,544,564 | B2 | 10/2013 | Moore et al. | 175/50 |
| 8,552,597 | B2 | 10/2013 | Song et al. | 307/149 |
| 8,556,302 | B2 | 10/2013 | Dole | 285/367 |

(56) References Cited

U.S. PATENT DOCUMENTS 8,559,272 B2 10/2013 Wang
8,596,359 B2 12/2013 Grigsby et al. ..... 166/278
8,605,548 B2 12/2013 Froelich ..... 367/82
8,607,864 B2 12/2013 Mcleod et al. ..... 166/250.1
8,664,958 B2 3/2014 Simon ..... 324/338
8,672,875 B2 3/2014 Vanderveen et al. ..... 604/67
8,675,779 B2 3/2014 Zeppetelle et al. ..... 375/340
8,683,859 B2 4/2014 Godager ..... 73/152.54
8,689,621 B2 4/2014 Godager ..... 73/152.54
8,701,480 B2 4/2014 Eriksen ..... 73/152.51
8,750,789 B2 6/2014 Baldemair et al. ..... 455/11.1
8,787,840 B2 7/2014 Srinivasan et al. ..... 455/69
8,805,632 B2 8/2014 Coman et al. ..... 702/89
8,826,980 B2 9/2014 Neer ..... 166/255.1
8,833,469 B2 9/2014 Purkis ..... 166/373
8,893,784 B2 11/2014 Abad ..... E21B 43/26
8,910,716 B2 12/2014 Newton et al. ..... 166/373
8,994,550 B2 3/2015 Millot et al. ..... E21B 47/16
8,995,837 B2 3/2015 Mizuguchi et al. ... H04B 10/27
9,062,508 B2 6/2015 Huval et al. ..... E21B 47/122
9,062,531 B2 6/2015 Jones ..... E21B 47/082
9,075,155 B2 7/2015 Luscombe et al. .... G01V 1/226
9,078,055 B2 7/2015 Nguyen et al. ..... H04R 5/00
9,091,153 B2 7/2015 Yang et al. ..... E21B 47/12
9,133,705 B2 9/2015 Angeles Boza ..... E21B 47/12
9,140,097 B2 9/2015 Themig et al. ..... E21B 34/12
9,144,894 B2 9/2015 Barnett et al. ..... B25B 17/00
9,206,645 B2 12/2015 Hallundbaek ..... E21B 7/04
9,279,301 B2 3/2016 Lovorn et al. ..... E21B 21/103
9,284,819 B2 3/2016 Tolman et al. ..... E21B 41/00
9,284,834 B2 3/2016 Alteirac et al. ..... E21B 47/12
9,310,510 B2 4/2016 Godager ..... G01V 3/38
9,333,350 B2 5/2016 Rise et al. ..... A61N 1/36082
9,334,696 B2 5/2016 Hay ..... E21B 47/12
9,359,841 B2 6/2016 Hall ..... E21B 23/00
9,363,605 B2 6/2016 Goodman et al. ..... H04R 17/00
9,376,908 B2 6/2016 Ludwig et al. ..... E21B 47/01
9,441,470 B2 9/2016 Guerrero et al. ..... E21B 43/14
9,515,748 B2 12/2016 Jeong et al. ..... G10L 25/90
9,557,434 B2 1/2017 Keller et al. ..... G01V 1/52
9,617,829 B2 4/2017 Dale et al. ..... E21B 41/00
9,617,850 B2 4/2017 Fripp et al. ..... E21B 47/18
9,631,485 B2 4/2017 Keller et al. ..... E21B 47/16
9,657,564 B2 5/2017 Stolpman ..... E21B 47/16
9,664,037 B2 5/2017 Logan et al. ..... E21B 47/122
9,670,773 B2 6/2017 Croux ..... E21B 47/16
9,683,434 B2 6/2017 Machocki ..... E21B 44/00
9,686,021 B2 6/2017 Merino ..... E21B 47/16
9,715,031 B2 7/2017 Contant et al. ..... E21B 47/122
9,721,448 B2 8/2017 Wu ..... G08B 21/20
9,759,062 B2 9/2017 Deffenbaugh et al. ..... E21B 47/16
9,816,373 B2 11/2017 Howell et al. ..... E21B 47/16
9,822,634 B2 11/2017 Gao ..... E21B 47/16
9,863,222 B2 1/2018 Morrow et al. ..... E21B 43/122
9,879,525 B2 1/2018 Morrow et al. ..... E21B 47/12
9,945,204 B2 4/2018 Ross et al. ..... E21B 33/127
9,963,955 B2 5/2018 Tolman et al. ..... E21B 43/119
10,100,635 B2 10/2018 Keller et al. ..... E21B 47/18
10,103,846 B2 10/2018 van Zelm et al. ..... E21B 47/12
10,132,149 B2 11/2018 Morrow et al. ..... E21B 43/267
10,145,228 B2 12/2018 Yarus et al. ..... E21B 44/00
10,167,716 B2 1/2019 Clawson et al. ..... E21B 47/14
10,167,717 B2 1/2019 Deffenbaugh et al. ..... E21B 47/16
10,190,410 B2 1/2019 Clawson et al. ..... E21B 47/14
10,196,862 B2 2/2019 Li-Leger et al. ..... E21B 17/02
2002/0180613 A1 12/2002 Shi et al. ..... E21B 47/18
2003/0056953 A1 3/2003 Tumlin et al. ..... 166/298
2003/0117896 A1 6/2003 Sakuma et al. ..... 367/81
2004/0020063 A1 2/2004 Lewis et al. ..... 33/313
2004/0200613 A1 10/2004 Fripp et al. ..... 166/250.01
2004/0239521 A1 12/2004 Zierolf ..... 340/854.1
2005/0269083 A1 12/2005 Burris, II et al. ..... 166/255.2
2005/0284659 A1 12/2005 Hall et al. ..... 175/27
2006/0033638 A1 2/2006 Hall et al. ..... 340/854.6
2006/0041795 A1 2/2006 Gabelmann et al. ..... 714/699
2006/0090893 A1 5/2006 Sheffield ..... 166/250.15
2007/0139217 A1 6/2007 Beique et al. ..... 340/856.3
2007/0146351 A1 6/2007 Katsurahira et al. ..... 345/179
2007/0156359 A1 7/2007 Varsamis et al. ..... 702/69
2007/0219758 A1 9/2007 Bloomfield ..... 702/190
2007/0272411 A1 11/2007 Lopez de Cardenas et al. ..... 166/305.1
2008/0030365 A1 2/2008 Fripp et al. ..... E21B 47/16
2008/0110644 A1 5/2008 Howell et al. ..... 166/387
2008/0185144 A1 8/2008 Lovell ..... 166/250.17
2008/0304360 A1 12/2008 Mozer ..... 367/117
2009/0003133 A1 1/2009 Dalton et al. ..... 367/82
2009/0030614 A1 1/2009 Carnegie et al. ..... 702/6
2009/0034368 A1 2/2009 Johnson ..... 367/83
2009/0045974 A1 2/2009 Patel ..... 340/854.6
2009/0080291 A1 3/2009 Tubel et al. ..... 367/81
2009/0166031 A1 7/2009 Hernandez ..... 166/250.01
2010/0013663 A1 1/2010 Cavender et al. ..... 340/854.3
2010/0089141 A1 4/2010 Rioufol et al. ..... 73/152.28
2010/0133004 A1 6/2010 Burleson et al. ..... 175/2
2010/0182161 A1 7/2010 Robbins et al. ..... 340/853.7
2010/0212891 A1 8/2010 Stewart et al. ..... 166/250.12
2011/0061862 A1 3/2011 Loretz et al. ..... 166/250.11
2011/0066378 A1 3/2011 Lerche et al. ..... 702/6
2011/0168403 A1 7/2011 Patel ..... 166/373
2011/0176387 A1 7/2011 Froelich
2011/0188345 A1 8/2011 Wang ..... 367/34
2011/0297376 A1 12/2011 Holderman et al. ..... 166/278
2011/0297673 A1 12/2011 Zbat et al. ..... 219/756
2011/0301439 A1 12/2011 Albert et al. ..... 600/301
2011/0315377 A1 12/2011 Rioufol ..... 166/250.17
2012/0043079 A1 2/2012 Wassouf et al. ..... 166/250
2012/0126992 A1 5/2012 Rodney et al. ..... 340/850
2012/0152562 A1 6/2012 Newton et al. ..... 166/369
2012/0179377 A1 7/2012 Lie ..... 702/6
2013/0000981 A1 1/2013 Grimmer et al. ..... 175/45
2013/0003503 A1 1/2013 L'Her et al. ..... 367/106
2013/0106615 A1 5/2013 Prammer ..... 340/854.6
2013/0138254 A1 5/2013 Seals et al. ..... 700/282
2013/0192823 A1 8/2013 Barrilleaux et al. ..... 166/250.01
2013/0248172 A1 9/2013 Angeles Boza et al.
2013/0278432 A1 10/2013 Shashoua et al. ..... 340/853.7
2013/0319102 A1 12/2013 Riggenberg et al. ..... 73/152.28
2014/0060840 A1 3/2014 Hartshorne et al. ..... 166/300
2014/0062715 A1 3/2014 Clark ..... 340/853.2
2014/0102708 A1 4/2014 Purkis et al. ..... 166/308.1
2014/0133276 A1 5/2014 Volker et al. ..... 367/82
2014/0152659 A1 6/2014 Davidson et al. ..... 345/420
2014/0153368 A1 6/2014 Bar-Cohen et al. ..... 367/81
2014/0166266 A1 6/2014 Read ..... 166/250.01
2014/0170025 A1 6/2014 Weiner et al. ..... 422/82.01
2014/0266769 A1 9/2014 van Zelm ..... 340/854.3
2014/0327552 A1 11/2014 Filas et al. ..... 340/854.6
2014/0352955 A1 12/2014 Tubel et al. ..... 166/250.15
2015/0003202 A1 1/2015 Palmer et al. ..... 367/82
2015/0009040 A1 1/2015 Bowles et al. ..... 340/854.6
2015/0027687 A1 1/2015 Tubel ..... 166/72
2015/0041124 A1 2/2015 Rodriguez ..... 166/255.1
2015/0041137 A1 2/2015 Rodriguez ..... 166/301
2015/0152727 A1 6/2015 Fripp et al. ..... E21B 47/14
2015/0159481 A1 6/2015 Mebarkia et al. .... E21B 47/065
2015/0167425 A1 6/2015 Hammer et al. ..... E21B 34/06
2015/0176370 A1 6/2015 Greening et al. ..... E21B 41/00
2015/0292319 A1 10/2015 Disko et al. ..... E21B 47/16
2015/0292320 A1 10/2015 Lynk et al. ..... E21B 47/16
2015/0300159 A1 10/2015 Stiles et al. ..... E21B 47/16
2015/0330200 A1 11/2015 Richard et al. ..... E21B 44/00
2015/0337642 A1 11/2015 Spacek ..... E21B 44/005
2015/0354351 A1 12/2015 Morrow et al. ..... E21B 47/16
2015/0377016 A1 12/2015 Ahmad ..... E21B 47/122
2016/0010446 A1 1/2016 Logan et al. ..... E21B 47/122
2016/0047230 A1 2/2016 Livescu et al. ..... E21B 47/10
2016/0047233 A1 2/2016 Butner et al. ..... E21B 47/12
2016/0076363 A1 3/2016 Morrow et al. ..... E21B 47/12

(56) References Cited

U.S. PATENT DOCUMENTS

| | | | | |
|---|---|---|---|---|
| 2016/0109606 | A1 | 4/2016 | Market et al. | G01V 1/50 |
| 2016/0215612 | A1 | 7/2016 | Morrow | E21B 47/122 |
| 2016/0237759 | A1 | 8/2016 | Li-Leger et al. | |
| 2017/0138185 | A1 | 5/2017 | Saed et al. | E21B 47/16 |
| 2017/0145811 | A1 | 5/2017 | Robison et al. | E21B 47/0007 |
| 2017/0152741 | A1 | 6/2017 | Park et al. | E21B 47/123 |
| 2017/0167249 | A1 | 6/2017 | Lee et al. | E21B 47/14 |
| 2017/0204719 | A1 | 7/2017 | Babakhani | E21B 47/0005 |
| 2017/0254183 | A1 | 9/2017 | Vasques et al. | E21B 47/16 |
| 2017/0293044 | A1* | 10/2017 | Gilstrap | G01V 1/50 |
| 2017/0314386 | A1 | 11/2017 | Orban et al. | E21B 47/091 |
| 2018/0010449 | A1 | 1/2018 | Roberson et al. | E21B 47/16 |
| 2018/0058191 | A1 | 3/2018 | Romer et al. | E21B 47/0007 |
| 2018/0058198 | A1 | 3/2018 | Ertas et al. | E21B 47/12 |
| 2018/0058202 | A1 | 3/2018 | Disko et al. | E21B 47/14 |
| 2018/0058203 | A1 | 3/2018 | Clawson et al. | E21B 47/14 |
| 2018/0058204 | A1 | 3/2018 | Clawson et al. | E21B 47/14 |
| 2018/0058205 | A1 | 3/2018 | Clawson et al. | E21B 47/14 |
| 2018/0058206 | A1 | 3/2018 | Zhang et al. | E21B 47/16 |
| 2018/0058207 | A1 | 3/2018 | Song et al. | E21B 47/16 |
| 2018/0058208 | A1 | 3/2018 | Song et al. | E21B 47/16 |
| 2018/0058209 | A1 | 3/2018 | Song et al. | E21B 47/16 |
| 2018/0066490 | A1 | 3/2018 | Kjos | E21B 33/035 |
| 2018/0066510 | A1 | 3/2018 | Walker et al. | E21B 47/011 |

FOREIGN PATENT DOCUMENTS

| | | | | |
|---|---|---|---|---|
| EP | 0636763 | | 2/1995 | E21B 47/12 |
| EP | 1409839 | | 4/2005 | E21B 43/1185 |
| EP | 2677698 | | 12/2013 | H04L 12/28 |
| WO | WO2002/027139 | | 4/2002 | E21B 43/12 |
| WO | WO2010/074766 | | 7/2010 | A41C 1/14 |
| WO | WO2013/079928 | | 6/2013 | E21B 47/12 |
| WO | WO 2013/079928 | A2 | 6/2013 | |
| WO | WO 2013/112273 | A2 | 8/2013 | |
| WO | WO2014/018010 | | 1/2014 | E21B 47/12 |
| WO | WO 2014/018010 | A1 | 1/2014 | |
| WO | WO2014/049360 | | 4/2014 | E21B 47/12 |
| WO | WO 2014/049360 | A2 | 4/2014 | |
| WO | WO2014/100271 | | 6/2014 | E21B 47/12 |
| WO | WO2014/134741 | | 9/2014 | E21B 47/13 |
| WO | WO 2014/134741 | A1 | 9/2014 | |
| WO | WO2015/117060 | | 8/2015 | E21B 47/12 |

OTHER PUBLICATIONS

U.S. Appl. No. 16/139,373, filed Sep. 24, 2018, Yi, Xiaohua et al.
U.S. Appl. No. 16/139,384, filed Oct. 13, 2017, Disko, Mark M. et al.
U.S. Appl. No. 16/139,394, filed Oct. 13, 2017, Song, Limin et al.
U.S. Appl. No. 16/139,403, filed Oct. 13, 2017, Song, Limin et al.
U.S. Appl. No. 16/139,414, filed Oct. 13, 2017, Zhang, Yibing et al.
U.S. Appl. No. 16/139,421, filed Oct. 13, 2017, Song, Limin et al.
U.S. Appl. No. 16/139,427, filed Oct. 13, 2017, Disko, Mark M. et al.
U.S. Appl. No. 16/175,418, filed Oct. 30, 2018, Kent, David K. et al.
U.S. Appl. No. 62/588,067, filed Nov. 17, 2017, Song, Limin et al.
U.S. Appl. No. 62/588,080, filed Nov. 17, 2017, Kinn, Timothy F. et al.
U.S. Appl. No. 62/588,103, filed Nov. 17, 2017, Yi, Xiaohua et al.
Arroyo, Javier et al. (2009) "Forecasting Histogram Time Series with K-Nearest Neighbours Methods," *International Journal of Forecasting*, v.25, pp. 192-207.
Arroyo, Javier et al. (2011) "Smoothing Methods for Histogram-Valued Time Seriers: An Application to Value-at-Risk," *Univ. of California, Dept. of Economics*, www.wileyonlinelibrary.com, Mar. 8, 2011.
Arroyo, Javier et al. (2011) "Forecasting with Interval and Histogram Data Some Financial Applications," *Univ. of California, Dept. of Economics*, 46 pages.
Emerson Process Management (2011), "Roxar downhole Wireless PT sensor system," www.roxar.com, or downhole@roxar.com, 2 pgs.
Gonzalez-Rivera, Gloria et al. (2012) "Time Series Modeling of Histogram-Valued Data: The Daily Histogram Time Series of S&P500 Intradaily Returns," *International Journal of Forecasting*, v.28, 36 pgs.
Gutierrez-Estevez, M. A. et al. (2013) "Acoustic Boardband Communications Over Deep Drill Strings using Adaptive OFDM", *IEEE Wireless Comm. & Networking Conf.*, pp. 4089-4094.
Qu, X. et al. (2011) "Reconstruction fo Self-Sparse 20 NMR Spectra From undersampled Data in the Indirect Dimension", pp. 8888-8909.
U.S. Department of Defense (1999) "Interoperability and Performance Standards for Medium and High Frequency Radio Systems," *MIL-STD-188-141B*, Mar. 1, 1999, 584 pages.

* cited by examiner

900

DUAL TRANSDUCER COMMUNICATIONS NODE FOR DOWNHOLE ACOUSTIC WIRELESS NETWORKS AND METHOD EMPLOYING SAME

CROSS REFERENCE TO RELATED APPLICATION

This application claims the benefit of U.S. Provisional Application Ser. No. 62/428,367, filed Nov. 30, 2016, entitled "Dual Transducer Communications Node for Downhole Acoustic Wireless Networks and Method Employing Same," U.S. Provisional Application Ser. No. 62/381,330 filed Aug. 30, 2016, entitled "Communication Networks, Relay Nodes for Communication Networks, and Methods of Transmitting Data Among a Plurality of Relay Nodes," U.S. Provisional Application Ser. No. 62/428,374, filed Nov. 30, 2016, entitled "Hybrid Downhole Acoustic Wireless Network," U.S. Provisional Application Ser. No. 62/428,385, filed Nov. 30, 2016 entitled "Methods of Acoustically Communicating And Wells That Utilize The Methods," U.S. Provisional Application Ser. No. 62/433,491, filed Dec. 13, 2016 entitled "Methods of Acoustically Communicating And Wells That Utilize The Methods," U.S. Provisional Application Ser. No. 62/428,394, filed Nov. 30, 2016, entitled "Downhole Multiphase Flow Sensing Methods," and U.S. Provisional Application Ser. No. 62/428,425 filed Nov. 30, 2016, entitled "Acoustic Housing for Tubulars," the disclosures of which are incorporated herein by reference in their entireties.

FIELD

The present disclosure relates generally to the field of data transmission along a tubular body, such as a steel pipe. More specifically, the present disclosure relates to the transmission of data along a pipe within a wellbore or along a pipeline, either at the surface or in a body of water.

BACKGROUND

In the oil and gas industry, it is desirable to obtain data from a wellbore. Several real time data systems have been proposed. One involves the use of a physical cable such as an electrical conductor or a fiber optic cable that is secured to the tubular body. The cable may be secured to either the inner or the outer diameter of the pipe. The cable provides a hard wire connection that allows for real-time transmission of data and the immediate evaluation of subsurface conditions. Further, these cables allow for high data transmission rates and the delivery of electrical power directly to downhole sensors.

It has been proposed to place a physical cable along the outside of a casing string during well completion. However, this can be difficult as the placement of wires along a pipe string requires that thousands of feet of cable be carefully unspooled and fed during pipe connection and run-in. Further, the use of hard wires in a well completion requires the installation of a specially-designed well head that includes through-openings for the wires.

Various wireless technologies have been proposed or developed for downhole communications. Such technologies are referred to in the industry as telemetry. Several examples exist where the installation of wires may be either technically difficult or economically impractical. The use of radio transmission may also be impractical or unavailable in cases where radio-activated blasting is occurring, or where the attenuation of radio waves near the tubular body is significant.

The use of acoustic telemetry has also been suggested. Acoustic telemetry employs an acoustic signal generated at or near the bottomhole assembly or bottom of a pipe string. The signal is transmitted through the wellbore pipe, meaning that the pipe becomes the carrier medium for sound waves. Transmitted sound waves are detected by a receiver and converted to electrical signals for analysis.

In the downhole application of acoustic telemetry wireless networks, communications reliability and range are two highly desirable performance issues. While the use of a single piezoelectric transducer with an associated transceiver offers fabrication advantages, design compromises can impact performance. For example, one major drawback of the single transducer/transceiver design is that both transmitter and receiver performance may be compromised in order to accommodate the single transducer design.

Accordingly, a need exists for alternative electro-acoustic communications node designs, for use in wellbore acoustic telemetry systems, which offer improved communications performance.

SUMMARY

In one aspect, provided is an electro-acoustic communications node for a downhole wireless telemetry system. The communications node includes a housing having a mounting face for mounting to a surface of a tubular body; a piezoelectric receiver positioned within the housing, the piezoelectric receiver structured and arranged to receive acoustic waves that propagate through the tubular member; a piezoelectric transmitter positioned within the housing, the piezoelectric transmitter structured and arranged to transmit acoustic waves through the tubular member; electronic circuits to effect transmission and reception; and a power source comprising one or more batteries positioned within the housing.

In some embodiments, the electro-acoustic communications node further includes separate electronics circuits to optimize the performance of the piezoelectric receiver and the piezoelectric transmitter. These embodiments may use completely independent circuits for each piezo electric transducer or may utilize components that are common to each piezo transducer.

In some embodiments, the piezoelectric transmitter includes multiple piezoelectric disks, each piezoelectric disk having at least a pair of electrodes connected in parallel with an adjacent piezoelectric disk. Fabrications with multiple transducers are referred to as a piezo stack. In some embodiments, a single voltage is applied equally to each piezoelectric disk. In the preferred embodiment, a single voltage is applied to the full piezo stack. In some embodiments, the mechanical output of the piezoelectric transmitter is increased by increasing the number of disks while applying the same voltage.

In some embodiments, the piezoelectric receiver comprises multiple piezoelectric disks in a stack, each piezoelectric disk having at least a pair of electrodes connected in series with an adjacent piezoelectric disk. In some embodiments, the piezoelectric receiver comprises a single piezoelectric disk, the single piezoelectric disk having a thickness equivalent to the total thickness of a multiple piezoelectric disk stack if appropriate.

In some embodiments, the piezo stacks may be fitted with an end mass, such as a front mass and/or back mass, or in combinations of sets thereof, to enhance or tune transmission output or receiver sensitivity. The end masses may provide properly timed reflections to improve the piezo performance. Moreover, the end mass and stack may be pre-tensioned to the housing or otherwise pre-loaded. Pre-tensioning (a.k.a. "pre-loading" in some writings) may provide benefits in certain applications such as to refine frequency operating ranges, resonances, amplitude, and or harmonic adjustments or fitting. Thereby, the output of the transmitter or received piezo or stack may be enhanced. Other potential benefits may include increasing receiver sensitivity, improving mechanical durability, and adapting service application environment adaptation for enhanced long term device performance and stability.

In some embodiments, the housing has a first end and a second end, each of which have a clamp associated therewith for clamping to an outer surface of the tubular body.

In another aspect, provided is a downhole wireless telemetry system. The downhole wireless telemetry system includes at least one sensor disposed along a tubular body; at least one sensor communications node placed along the tubular body and affixed to a wall of the tubular body, the sensor communications node being in electrical and/or acoustical communication with the at least one sensor and configured to receive signals therefrom; a topside communications node placed proximate a surface; a plurality of electro-acoustic communications nodes spaced along the tubular body and attached to a wall of the tubular body, each electro-acoustic communications node comprising a housing having a mounting face for mounting to a surface of the tubular body; a piezoelectric receiver positioned within the housing, the piezoelectric receiver structured and arranged to receive acoustic waves that propagate through the tubular member; a piezoelectric transmitter positioned within the housing, the piezoelectric transmitter structured and arranged to transmit acoustic waves through the tubular member; electronic circuits to effect transmission and reception; and a power source comprising one or more batteries positioned within the housing; wherein the electro-acoustic communications nodes are configured to transmit signals received from the at least one sensor communications node to the topside communications node in a substantially node-to-node arrangement. In some embodiments, the electronics circuit will include a microcontroller or processor with suitable software to manage telemetry transmissions, receptions, decoding and coding.

In some embodiments, the method further includes sending an acoustic signal from the piezoelectric transmitter of the electro-acoustic communications node; and determining from the acoustic response of the piezoelectric receiver at a different electro-acoustic communications node a physical parameter of the hydrocarbon well. In some embodiments, the method further includes repeating this at a different time, and measuring the change in acoustic response to determine whether a physical change in hydrocarbon well conditions has occurred.

BRIEF DESCRIPTION OF THE DRAWINGS

The present disclosure is susceptible to various modifications and alternative forms, specific exemplary implementations thereof have been shown in the drawings and are herein described in detail. It should be understood, however, that the description herein of specific exemplary implementations is not intended to limit the disclosure to the particular forms disclosed herein. This disclosure is to cover all modifications and equivalents as defined by the appended claims. It should also be understood that the drawings are not necessarily to scale, emphasis instead being placed upon clearly illustrating principles of exemplary embodiments of the present invention. Moreover, certain dimensions may be exaggerated to help visually convey such principles. Further where considered appropriate, reference numerals may be repeated among the drawings to indicate corresponding or analogous elements. Moreover, two or more blocks or elements depicted as distinct or separate in the drawings may be combined into a single functional block or element. Similarly, a single block or element illustrated in the drawings may be implemented as multiple steps or by multiple elements in cooperation. The forms disclosed herein are illustrated by way of example, and not by way of limitation, in the figures of the accompanying drawings and in which like reference numerals refer to similar elements and in which:

DETAILED DESCRIPTION

Terminology

Figure 1:
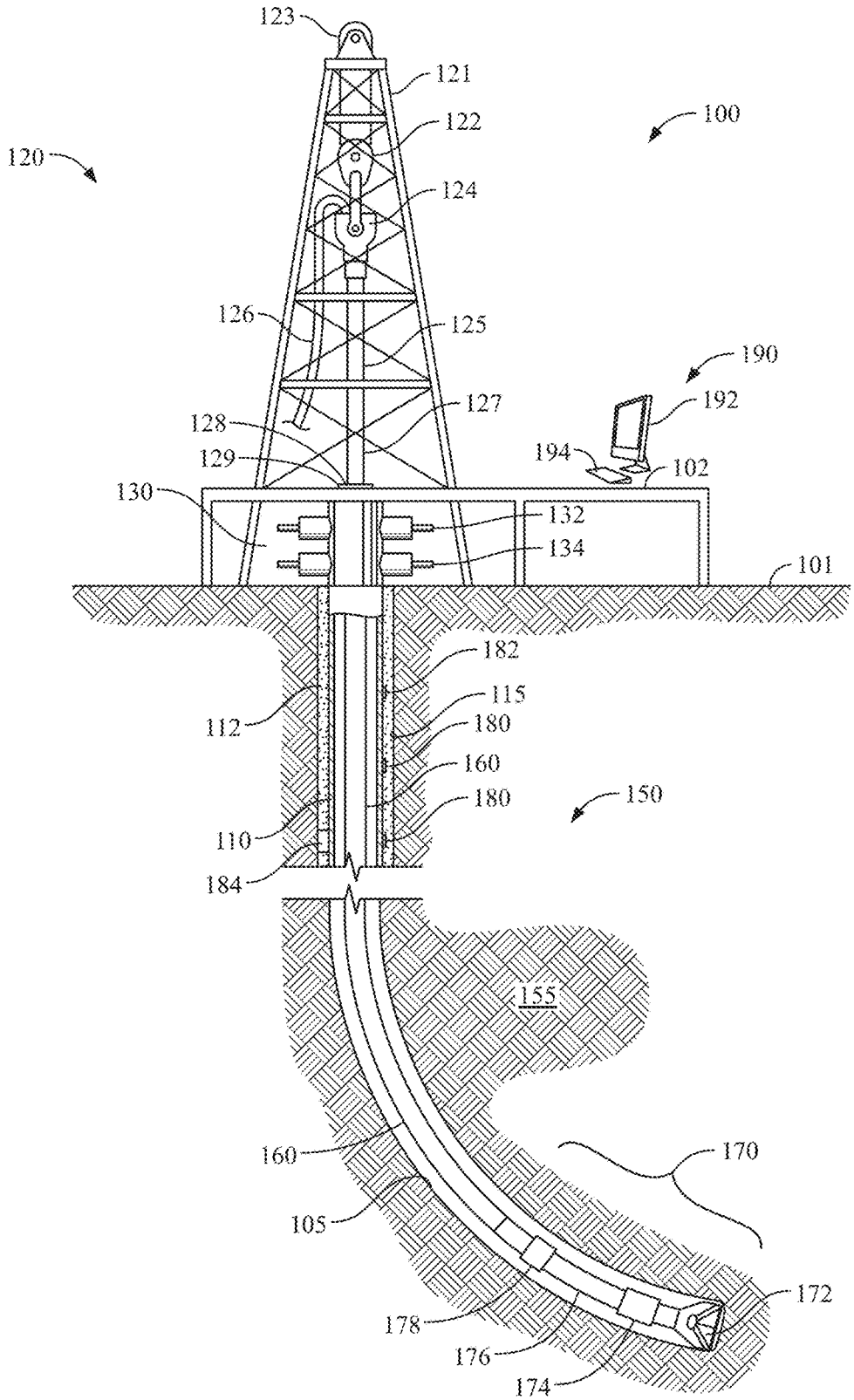
FIG. 1 presents a side, cross-sectional view of an illustrative, nonexclusive example of a wellbore. The wellbore is being formed using a derrick, a drill string and a bottomhole assembly. A series of communications nodes is placed along the drill string as part of a telemetry system, according to the present disclosure.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than the broadest meaning understood by skilled artisans, such a special or clarifying definition will be expressly set forth in the specification in a definitional manner that provides the special or clarifying definition for the term or phrase.

For example, the following discussion contains a non-exhaustive list of definitions of several specific terms used in this disclosure (other terms may be defined or clarified in a definitional manner elsewhere herein). These definitions are intended to clarify the meanings of the terms used herein. It is believed that the terms are used in a manner consistent with their ordinary meaning, but the definitions are nonetheless specified here for clarity.

A/an: The articles "a" and "an" as used herein mean one or more when applied to any feature in embodiments and implementations of the present invention described in the specification and claims. The use of "a" and "an" does not limit the meaning to a single feature unless such a limit is specifically stated. The term "a" or "an" entity refers to one or more of that entity. As such, the terms "a" (or "an"), "one or more" and "at least one" can be used interchangeably herein.

About: As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents which may otherwise be afforded a particular value. Further, unless otherwise stated, the term "about" shall expressly include "exactly," consistent with the discussion below regarding ranges and numerical data.

Above/below: In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore. Continuing with the example of relative directions in a wellbore, "upper" and "lower" may also refer to relative positions along the longitudinal dimension of a wellbore rather than relative to the surface, such as in describing both vertical and horizontal wells.

And/or: The term "and/or" placed between a first entity and a second entity means one of (1) the first entity, (2) the second entity, and (3) the first entity and the second entity. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements). As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of".

Any: The adjective "any" means one, some, or all indiscriminately of whatever quantity.

At least: As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements). The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Based on: "Based on" does not mean "based only on", unless expressly specified otherwise. In other words, the phrase "based on" describes both "based only on," "based at least on," and "based at least in part on."

Comprising: In the claims, as well as in the specification, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

Couple: Any use of any form of the terms "connect", "engage", "couple", "attach", or any other term describing an interaction between elements is not meant to limit the interaction to direct interaction between the elements and may also include indirect interaction between the elements described.

Determining: "Determining" encompasses a wide variety of actions and therefore "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

Embodiments: Reference throughout the specification to "one embodiment," "an embodiment," "some embodiments," "one aspect," "an aspect," "some aspects," "some implementations," "one implementation," "an implementation," or similar construction means that a particular component, feature, structure, method, or characteristic described in connection with the embodiment, aspect, or implementation is included in at least one embodiment and/or implementation of the claimed subject matter. Thus, the appearance of the phrases "in one embodiment" or "in an embodiment" or "in some embodiments" (or "aspects" or "implementations") in various places throughout the specification are not necessarily all referring to the same embodiment and/or implementation. Furthermore, the particular features, structures, methods, or characteristics may be combined in any suitable manner in one or more embodiments or implementations.

Exemplary: "Exemplary" is used exclusively herein to mean "serving as an example, instance, or illustration." Any embodiment described herein as "exemplary" is not necessarily to be construed as preferred or advantageous over other embodiments.

Flow diagram: Exemplary methods may be better appreciated with reference to flow diagrams or flow charts. While for purposes of simplicity of explanation, the illustrated methods are shown and described as a series of blocks, it is to be appreciated that the methods are not limited by the order of the blocks, as in different embodiments some blocks may occur in different orders and/or concurrently with other blocks from that shown and described. Moreover, less than all the illustrated blocks may be required to implement an exemplary method. In some examples, blocks may be combined, may be separated into multiple components, may employ additional blocks, and so on. In some examples, blocks may be implemented in logic. In other examples, processing blocks may represent functions and/or actions performed by functionally equivalent circuits (e.g., an analog circuit, a digital signal processor circuit, an application specific integrated circuit (ASIC)), or other logic device. Blocks may represent executable instructions that cause a computer, processor, and/or logic device to respond, to perform an action(s), to change states, and/or to make decisions. While the figures illustrate various actions occurring in serial, it is to be appreciated that in some examples various actions could occur concurrently, substantially in series, and/or at substantially different points in time. In some examples, methods may be implemented as processor executable instructions. Thus, a machine-readable medium may store processor executable instructions that if executed by a machine (e.g., processor) cause the machine to perform a method.

Full-physics: As used herein, the term "full-physics," "full physics computational simulation," or "full physics simulation" refers to a mathematical algorithm based on first principles that impact the pertinent response of the simulated system.

May: Note that the word "may" is used throughout this application in a permissive sense (i.e., having the potential to, being able to), not a mandatory sense (i.e., must).

Operatively connected and/or coupled: Operatively connected and/or coupled means directly or indirectly connected for transmitting or conducting information, force, energy, or matter.

Optimizing: The terms "optimal," "optimizing," "optimize," "optimality," "optimization" (as well as derivatives and other forms of those terms and linguistically related words and phrases), as used herein, are not intended to be limiting in the sense of requiring the present invention to find the best solution or to make the best decision. Although a mathematically optimal solution may in fact arrive at the best of all mathematically available possibilities, real-world embodiments of optimization routines, methods, models, and processes may work towards such a goal without ever actually achieving perfection. Accordingly, one of ordinary skill in the art having benefit of the present disclosure will appreciate that these terms, in the context of the scope of the present invention, are more general. The terms may describe one or more of: 1) working towards a solution which may be the best available solution, a preferred solution, or a solution that offers a specific benefit within a range of constraints; 2) continually improving; 3) refining; 4) searching for a high point or a maximum for an objective; 5) processing to reduce a penalty function; 6) seeking to maximize one or more factors in light of competing and/or cooperative interests in maximizing, minimizing, or otherwise controlling one or more other factors, etc.

Order of steps: It should also be understood that, unless clearly indicated to the contrary, in any methods claimed herein that include more than one step or act, the order of the steps or acts of the method is not necessarily limited to the order in which the steps or acts of the method are recited.

Ranges: Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of about 1 to about 200 should be interpreted to include not only the explicitly recited limits of 1 and about 200, but also to include individual sizes such as 2, 3, 4, etc. and sub-ranges such as 10 to 50, 20 to 100, etc. Similarly, it should be understood that when numerical ranges are provided, such ranges are to be construed as providing literal support for claim limitations that only recite the lower value of the range as well as claims limitation that only recite the upper value of the range. For example, a disclosed numerical range of 10 to 100 provides literal support for a claim reciting "greater than 10" (with no upper bounds) and a claim reciting "less than 100" (with no lower bounds).

As used herein, the term "formation" refers to any definable subsurface region. The formation may contain one or more hydrocarbon-containing layers, one or more non-hydrocarbon containing layers, an overburden, and/or an underburden of any geologic formation.

As used herein, the term "hydrocarbon" refers to an organic compound that includes primarily, if not exclusively, the elements hydrogen and carbon. Examples of hydrocarbons include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient conditions (20° C. and 1 atm pressure). Hydrocarbon fluids may include, for example, oil, natural gas, gas condensates, coal bed methane, shale oil, shale gas, and other hydrocarbons that are in a gaseous or liquid state.

As used herein, the terms "series" and "parallel" when referring to the assembly of piezo disks in a stack considers the polarization of the individual elements (the disks) in the stack. In a parallel stack, the electrodes with a consistent polarization are connected together. In a series stack, electrodes with opposite polarization are connected together.

As used herein, the term "potting" refers to the encapsulation of electrical components with epoxy, elastomeric, silicone, or asphaltic or similar compounds for the purpose of excluding moisture or vapors. Potted components may or may not be hermetically sealed.

As used herein, the term "sealing material" refers to any material that can seal a cover of a housing to a body of a housing sufficient to withstand one or more downhole conditions including but not limited to, for example, temperature, humidity, soil composition, corrosive elements, pH, and pressure.

As used herein, the term "sensor" includes any electrical sensing device or gauge. The sensor may be capable of monitoring or detecting pressure, temperature, fluid flow, vibration, resistivity, or other formation data. Alternatively, the sensor may be a position sensor.

As used herein, the term "subsurface" refers to geologic strata occurring below the earth's surface.

The terms "tubular member" or "tubular body" refer to any pipe, such as a joint of casing, a portion of a liner, a drill string, a production tubing, an injection tubing, a pup joint, a buried pipeline, underwater piping, or above-ground piping.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

The terms "zone" or "zone of interest" refer to a portion of a subsurface formation containing hydrocarbons. The term "hydrocarbon-bearing formation" may alternatively be used.

Description

Specific forms will now be described further by way of example. While the following examples demonstrate certain forms of the subject matter disclosed herein, they are not to be interpreted as limiting the scope thereof, but rather as contributing to a complete description.

FIG. 1 is a side, cross-sectional view of an illustrative well site 100. The well site 100 includes a derrick 120 at an earth surface 101. The well site 100 also includes a wellbore 150 extending from the earth surface 101 and down into an earth subsurface 155. The wellbore 150 is being formed using the derrick 120, a drill string 160 below the derrick 120, and a bottom hole assembly 170 at a lower end of the drill string 160.

Referring first to the derrick 120, the derrick 120 includes a frame structure 121 that extends up from the earth surface 101. The derrick 120 supports drilling equipment including a traveling block 122, a crown block 123 and a swivel 124. A so-called kelly 125 is attached to the swivel 124. The kelly 125 has a longitudinally extending bore (not shown) in fluid communication with a kelly hose 126. The kelly hose 126, also known as a mud hose, is a flexible, steel-reinforced, high-pressure hose that delivers drilling fluid through the bore of the kelly 125 and down into the drill string 160.

The kelly 125 includes a drive section 127. The drive section 127 is non-circular in cross-section and conforms to an opening 128 longitudinally extending through a kelly drive bushing 129. The kelly drive bushing 129 is part of a rotary table. The rotary table is a mechanically driven device that provides clockwise (as viewed from above) rotational force to the kelly 125 and connected drill string 160 to facilitate the process of drilling a borehole 105. Both linear and rotational movement may thus be imparted from the kelly 125 to the drill string 160.

A platform 102 is provided for the derrick 120. The platform 102 extends above the earth surface 101. The platform 102 generally supports rig hands along with various components of drilling equipment such as pumps, motors, gauges, a dope bucket, tongs, pipe lifting equipment and control equipment. The platform 102 also supports the rotary table.

It is understood that the platform 102 shown in FIG. 1 is somewhat schematic. It is also understood that the platform 102 is merely illustrative and that many designs for drilling rigs and platforms, both for onshore and for offshore operations, exist. These include, for example, top drive drilling systems. The claims provided herein are not limited by the configuration and features of the drilling rig unless expressly stated in the claims.

Placed below the platform 102 and the kelly-drive section 127 but above the earth surface 101 is a blow-out preventer, or BOP 130. The BOP 130 is a large, specialized valve or set of valves used to control pressures during the drilling of oil and gas wells. Specifically, blowout preventers control the fluctuating pressures emanating from subterranean formations during a drilling process. The BOP 130 may include upper 132 and lower 134 rams used to isolate flow on the back side of the drill string 160. Blowout preventers 130 also prevent the pipe joints making up the drill string 160 and the drilling fluid from being blown out of the wellbore 150 in the event of a sudden pressure kick.

As shown in FIG. 1, the wellbore 150 is being formed down into the subsurface formation 155. In addition, the wellbore 150 is being shown as a deviated wellbore. Of course, this is merely illustrative as the wellbore 150 may be a vertical well or even a horizontal well, as shown later in FIG. 2.

In drilling the wellbore 150, a first string of casing 110 is placed down from the surface 101. This is known as surface casing 110 or, in some instances (particularly offshore), conductor pipe. The surface casing 110 is secured within the formation 155 by a cement sheath 112. The cement sheath 112 resides within an annular region 115 between the surface casing 110 and the surrounding formation 155.

During the process of drilling and completing the wellbore 150, additional strings of casing (not shown) will be provided. These may include intermediate casing strings and a final production casing string. For an intermediate case string or the final production casing, a liner may be employed, that is, a string of casing that is not tied back to the surface 101.

As noted, the wellbore 150 is formed by using a bottomhole assembly 170. The bottomhole assembly 170 allows the operator to control or "steer" the direction or orientation of the wellbore 150 as it is formed. In this instance, the bottomhole assembly 170 is known as a rotary steerable drilling system, or RSS.

The bottomhole assembly 170 will include a drill bit 172. The drill bit 172 may be turned by rotating the drill string 160 from the platform 102. Alternatively, the drill bit 172 may be turned by using so-called mud motors 174. The mud motors 174 are mechanically coupled to and turn the nearby drill bit 172. The mud motors 174 are used with stabilizers or bent subs 176 to impart an angular deviation to the drill bit 172. This, in turn, deviates the well from its previous path in the desired azimuth and inclination.

There are several advantages to directional drilling. These primarily include the ability to complete a wellbore along a substantially horizontal axis of a subsurface formation, thereby exposing a greater formation face. These also include the ability to penetrate into subsurface formations that are not located directly below the wellhead. This is particularly beneficial where an oil reservoir is located under an urban area or under a large body of water. Another benefit of directional drilling is the ability to group multiple wellheads on a single platform, such as for offshore drilling. Finally, directional drilling enables multiple laterals and/or sidetracks to be drilled from a single wellbore in order to maximize reservoir exposure and recovery of hydrocarbons.

The illustrative well site 100 also includes a sensor 178. In some embodiments, the sensor 178 is part of the bottomhole assembly 170. The sensor 178 may be, for example, a set of position sensors that is part of the electronics for an RSS. Alternatively or in addition, the sensor 178 may be a temperature sensor, a pressure sensor, or other sensor for detecting a downhole condition during drilling. Alternatively still, the sensor may be an induction log or gamma ray log or other log that detects fluid and/or geology downhole.

The sensor 178 may be part of a Measurement While Drilling (MWD) or a Logging While Drilling (LWD) assembly. It is observed that the sensor 178 is located above the mud motors 174. This allows the electronic components of the sensor 178 to be spaced apart from the high vibration and centrifugal forces caused by the motors 174, the rotating assembly below the motors, and the formation cutting action created at the bit 172.

Where the sensor 178 is a set of position sensors, the sensors may include three inclinometer sensors and three environmental acceleration sensors. Ideally, a temperature sensor and a wear sensor will also be placed in the drill bit 172. These signals are input into a multiplexer and transmitted.

As the wellbore 150 is being formed, the operator may wish to evaluate the integrity of the cement sheath 112 placed around the surface casing 110 (or other casing string). To do this, the industry has relied upon so-called cement bond logs. As discussed above, a cement bond log (or CBL), uses an acoustic signal that is transmitted by a logging tool at the end of a wireline. The logging tool includes a transmitter, and one or more receivers that "listen" for sound waves generated by the transmitter through the surrounding casing string. The logging tool includes a signal processor that takes a continuous measurement of the amplitude of sound pulses from the transmitter to the receiver. Alternately, the attenuation of the sonic signal may be measured.

In some instances, a bond log will measure acoustic impedance of the material in the annulus directly behind the casing. This may be done through resonant frequency decay. Such logs include, for example, the USIT log of Schlumberger (of Sugar Land, Tex.) and the CAST-V log of Halliburton (of Houston, Tex.).

It is desirable to implement a downhole telemetry system that enables the operator to evaluate cement sheath integrity without need of running a CBL line. This enables the operator to check cement sheath integrity as soon as the cement has set in the annular region 115 or as soon as the wellbore 150 is completed. Additionally or alternatively, one or more sensors (not shown) may be deployed downhole to monitor a wide variety of properties, including, but not limited to, fluid characteristics, temperature, depth, etc., as those skilled in the art will plainly understand.

To do this, the well site 100 includes a plurality of battery-powered intermediate communications nodes 180. The battery-powered intermediate communications nodes 180 may be placed along the outer surface of the surface casing 110 or other tubular supporting the nodes 180, and according to a pre-designated spacing. The battery-powered intermediate communications nodes 180 are configured to receive and then relay acoustic signals along the length of the wellbore 150 in node-to-node arrangement up to the topside communications node 182. The topside communications node 182 is placed closest to the surface 101. The topside communications node 182 is configured to receive acoustic signals and convert them to electrical or optical signals. The topside communications node 182 may be above grade or below grade. Below grade communication nodes are typically installed while the casing tubular are above grade, prior to the insertion of the casing tubulars into the wellbore.

The nodes may also include a sensor communications node 184. The sensor communications node is placed closest to the sensor 178. The sensor communications node 184 is configured to communicate with the downhole sensor 178, and then send a wireless signal using an acoustic wave.

The well site 100 of FIG. 1 also shows a receiver 190. The receiver 190 comprises a processor 192 that receives signals sent from the topside communications node 182. The signals may be received through a wire (not shown) such as a co-axial cable, a fiber optic cable, a USB cable, or other electrical or optical communications wire. Alternatively, the receiver 190 may receive the final signals from the topside communications node 182 wirelessly through a modem, a transceiver or other wireless communications link such as Bluetooth or Wi-Fi. In some embodiments, the receiver 190 receives electrical signals via a so-called Class I, Division I conduit and housing for wiring that is considered acceptably safe in a potentially hazardous environment. Receiver 190 may be located in either an electrically classified or electrically unclassified area, as appropriate. In some applications, radio, infrared or microwave signals may be utilized.

The processor 192 may include discrete logic, any of various integrated circuit logic types, or a microprocessor. In any event, the processor 192 may be incorporated into a computer having a screen. The computer may have a separate keyboard 194, as is typical for a desk-top computer, or an integral keyboard as is typical for a laptop or a personal digital assistant. In one aspect, the processor 192 is part of a multi-purpose "smart phone" having specific "apps" and wireless connectivity. As indicated, the intermediate communications nodes 180 of the downhole telemetry system are typically powered by batteries and, as such, system energy limitations can be encountered. Power management must be considered in system design and optimization.

As has been described hereinabove, FIG. 1 illustrates the use of an acoustic wireless data telemetry system during a drilling operation. As may be appreciated, the acoustic downhole telemetry system may also be employed while a well is being drilled, after a well is drilled, after the well is completed, and/or combinations thereof.

Figure 2:
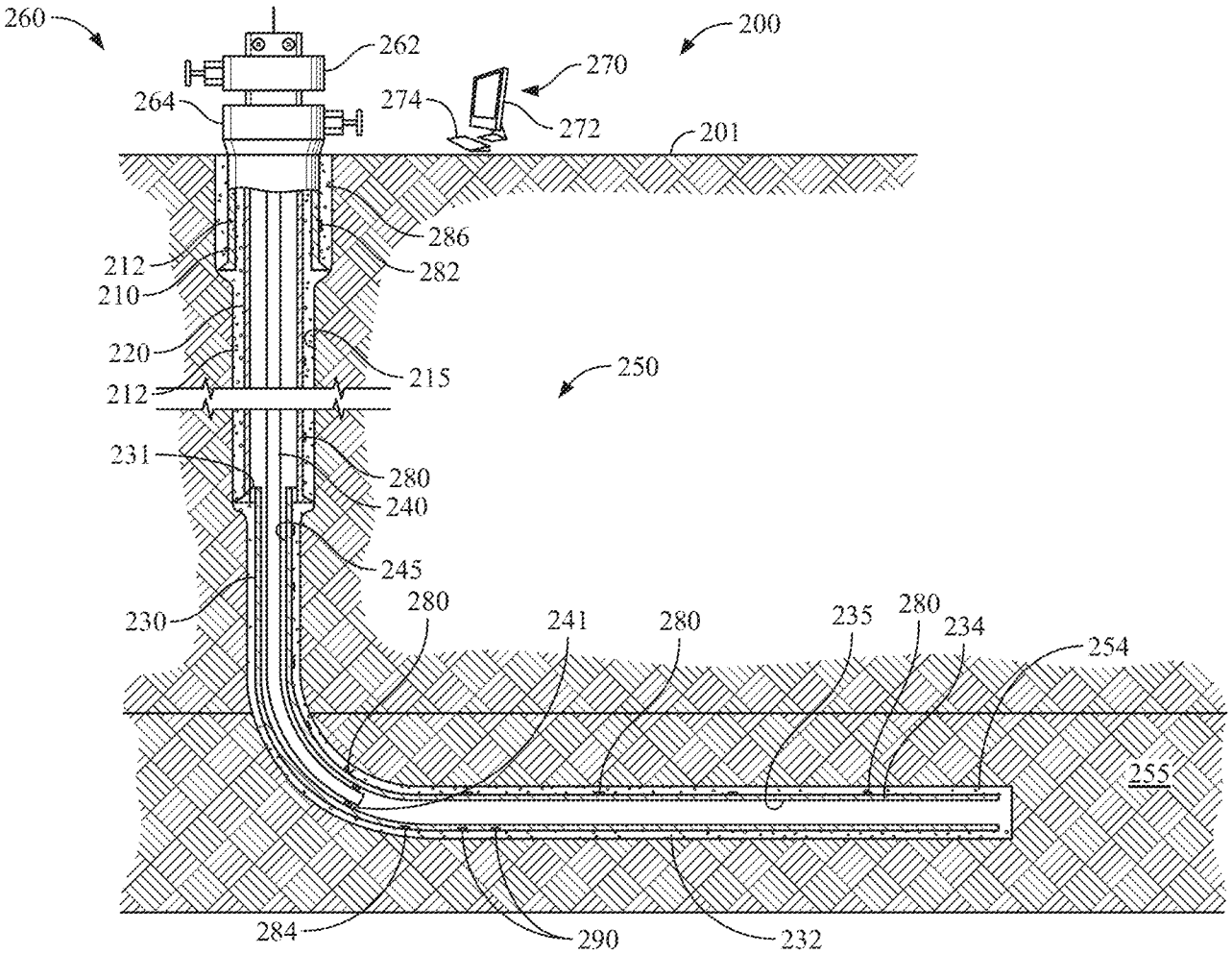
FIG. 2 presents a cross-sectional view of an illustrative, nonexclusive example of a wellbore having been completed. The illustrative wellbore has been completed as a cased hole completion. A series of communications nodes is placed along the casing string as part of a telemetry system, according to the present disclosure.

FIG. 2 is a cross-sectional view of an illustrative well site 200. The well site 200 includes a wellbore 250 that penetrates into a subsurface formation 255. The wellbore 250 has been completed as a cased-hole completion for producing hydrocarbon fluids. The well site 200 also includes a well head 260. The well head 260 is positioned at an earth surface 201 to control and direct the flow of formation fluids from the subsurface formation 255 to the surface 201.

Referring first to the well head 260, the well head 260 may be any arrangement of pipes or valves that receive reservoir fluids at the top of the well. In the arrangement of FIG. 2, the well head 260 represents a so-called Christmas tree. A Christmas tree is typically used when the subsurface formation 255 has enough in situ pressure to drive production fluids from the formation 255, up the wellbore 250, and to the surface 201. The illustrative well head 260 includes a top valve 262 and a bottom valve 264.

It is understood that rather than using a Christmas tree, the well head 260 may alternatively include a motor (or prime mover) at the surface 201 that drives a pump. The pump, in turn, reciprocates a set of sucker rods and a connected positive displacement pump (not shown) downhole. The pump may be, for example, a rocking beam unit or a hydraulic piston pumping unit. Alternatively still, the well head 260 may be configured to support a string of production tubing having a downhole electric submersible pump, a gas lift valve, or other means of artificial lift (not shown). The present inventions are not limited by the configuration of operating equipment at the surface unless expressly noted in the claims.

Referring next to the wellbore 250, the wellbore 250 has been completed with a series of pipe strings referred to as casing. First, a string of surface casing 210 has been cemented into the formation. Cement is shown in an annular bore 215 of the wellbore 250 around the casing 210. The cement is in the form of an annular sheath 212. The surface casing 110 (FIG. 1) has an upper end in sealed connection with the lower valve 264.

Next, at least one intermediate string of casing 220 is cemented into the wellbore 250. The intermediate string of casing 220 is in sealed fluid communication with the upper master valve 262. A cement sheath 212 is again shown in a bore 215 of the wellbore 250. The combination of the casing 210/220 and the cement sheath 212 in the bore 215 strengthens the wellbore 250 and facilitates the isolation of formations behind the casing 210/220.

It is understood that a wellbore 250 may, and typically will, include more than one string of intermediate casing. In some instances, an intermediate string of casing may be a liner.

Finally, a production string 230 is provided. The production string 230 is hung from the intermediate casing string 230 using a liner hanger 231. The production string 230 is a liner that is not tied back to the surface 201. In the arrangement of FIG. 2, a cement sheath 232 is provided around the liner 230.

The production liner 230 has a lower end 234 that extends to an end 254 of the wellbore 250. For this reason, the wellbore 250 is said to be completed as a cased-hole well. Those of ordinary skill in the art will understand that for production purposes, the liner 230 may be perforated after cementing to create fluid communication between a bore 235 of the liner 230 and the surrounding rock matrix making up the subsurface formation 255. In one aspect, the production string 230 is not a liner but is a casing string that extends back to the surface.

As an alternative, end 254 of the wellbore 250 may include joints of sand screen (not shown). The use of sand screens with gravel packs allows for greater fluid communication between the bore 235 of the liner 230 and the surrounding rock matrix while still providing support for the wellbore 250. In this instance, the wellbore 250 would include a slotted base pipe as part of the sand screen joints. Of course, the sand screen joints would not be cemented into place and would not include subsurface communications nodes.

The wellbore 250 optionally also includes a string of production tubing 240. The production tubing 240 extends from the well head 260 down to the subsurface formation 255. In the arrangement of FIG. 2, the production tubing 240 terminates proximate an upper end of the subsurface formation 255. A production packer 241 is provided at a lower end of the production tubing 240 to seal off an annular region 245 between the tubing 240 and the surrounding production liner 230. However, the production tubing 240 may extend closer to the end 234 of the liner 230. In some completions a production tubing 240 is not employed. This may occur, for example, when a monobore completion is used (or when using the presently disclosed technology with a surface or subsea pipeline).

It is also noted that the bottom end 234 of the production string 230 is completed substantially horizontally within the subsurface formation 255. This is a common orientation for wells that are completed in so-called "tight" or "unconventional" formations. Horizontal completions not only dramatically increase exposure of the wellbore to the producing rock face, but also enables the operator to create fractures that are substantially transverse to the direction of the wellbore. Those of ordinary skill in the art may understand that a rock matrix will generally "part" in a direction that is perpendicular to the direction of least principal stress. For deeper wells, that direction is typically substantially vertical. However, the present inventions have equal utility in vertically completed wells or in multi-lateral deviated wells.

As with the well site 100 of FIG. 1, the well site 200 of FIG. 2 includes a telemetry system that utilizes a series of novel communications nodes. This again may be for the purpose of evaluating the integrity of the cement sheath 212, 232. The communications nodes are placed along the outer diameter of the casing strings 210, 220, 230. These nodes allow for the high speed transmission of wireless signals based on the in situ generation of acoustic waves.

The nodes first include a topside communications node 282. The topside communications node 282 is placed closest to the surface 201. The topside node 282 is configured to transmit and receive acoustic signals. The topside node may be in communication with the surface communications and/or processors by any convenient means, such as but not limited to direct wired, wireless, acoustic, fiber optic, radio, cellular, or wireless.

In some embodiments, the nodes may also include a sensor communications node 284, located downhole, along the system communications path, and/or at or proximate the topside. Sensor communications nodes may be in one-way, two-way, passive, and/or active communication with one or more sensors. Sensors and/or sensor communications nodes may be locate inside of the wellbore tubulars, within wellbore tubulars, external to the wellbore tubulars, affixed to a wellbore tubular, or be conveyable within the wellbore such as via a tubing string, coil tubing, wireline, electrical wireline, autonomously, or pumped in by a fluid. The sensor communications node 284 may be placed near one or more sensors 290. Sensor communications node 284 is configured to communicate with the one or more downhole sensors 290, and then send a wireless signal pertaining to data from the sensor using acoustic waves and the transducers and acoustic telemetry system disclosed herewith.

The sensors 290 may be, for example, pressure sensors, flow meters, or temperature sensors. A pressure sensor may be, for example, a sapphire gauge or a quartz gauge. Sapphire gauges can be used as they are considered more rugged for the high-temperature downhole environment. Alternatively, the sensors may be microphones for detecting ambient noise, or geophones (such as a tri-axial geophone) for detecting the presence of micro-seismic activity. Alternatively still, the sensors may be fluid flow measurement devices such as a spinners, or fluid composition sensors.

In addition, the nodes include a plurality of subsurface battery-powered intermediate communications nodes 280. Each of the subsurface battery-powered intermediate communications nodes 280 is configured to receive and then relay acoustic signals along essentially the length of the wellbore 250. For example, the subsurface battery-powered intermediate communications nodes 280 can utilize electro-acoustic transducers to receive and relay mechanical or acoustical waves.

The subsurface battery-powered intermediate communications nodes 280 transmit signals as acoustic waves. The acoustic waves can be at a frequency of, for example, between about 50 kHz and 500 kHz. The signals are delivered up to the topside communications node 282 so that signals indicative of cement integrity are sent from node-to-node. A last subsurface battery-powered intermediate communications node 280 transmits the signals acoustically to the topside communications node 282. Communication may be between adjacent nodes or may skip nodes depending on node spacing or communication range. Preferably, communication is routed around nodes which are not functioning properly.

The well site 200 of FIG. 2 shows a receiver 270. The receiver 270 can comprise a processor 272 that receives signals sent from the topside communications node 282. The processor 272 may include discrete logic, any of various integrated circuit logic types, or a microprocessor. The receiver 270 may include a screen and a keyboard 274 (either as a keypad or as part of a touch screen). The receiver 270 may also be an embedded controller with neither a screen nor a keyboard which communicates with a remote computer such as via wireless, cellular modem, or telephone lines.

The signals may be received by the processor 272 through a wire (not shown) such as a co-axial cable, a fiber optic cable, a USB cable, or other electrical or optical communications wire. Alternatively, the receiver 270 may receive the final signals from the topside node 282 wirelessly through a modem, microwave, radio, optical, or other transceiver. Receiver 270 may also be a transmitter that can transmit commands to topside node 282 or directly to other in-range nodes (electrically, acoustically, wirelessly, or otherwise), which the topside node 282 or other topside receiving node may then in turn transmit the command downhole acoustically along the transducer communication chain to a designated downhole receiving node or transducer.

FIGS. 1 and 2 present illustrative wellbores 150, 250 that may receive a downhole telemetry system using acoustic transducers. In each of FIGS. 1 and 2, the top of the drawing page is intended to be toward the surface and the bottom of the drawing page toward the well bottom. While wells commonly are completed in substantially vertical orientation, it is understood that wells may also be inclined and even horizontally completed. When the descriptive terms "up" and "down" or "upper" and "lower" or similar terms are used in reference to a drawing, they are intended to indicate location on the drawing page, and not necessarily orientation in the ground, as the present inventions have utility no matter how the wellbore is orientated.

In each of FIGS. 1 and 2, the battery-powered intermediate communications nodes 180, 280 are specially designed to withstand the same corrosive and environmental conditions (for example, high temperature, high pressure) of a wellbore 150 or 250, as the casing strings, drill string, or production tubing. To do so, it is preferred that the battery-powered intermediate communications nodes 180, 280 include sealed steel housings for holding the electronics. In one aspect, the steel material is a corrosion resistant alloy. In another aspect, the steel material is compositionally similar to the wellbore tubular.

Figure 3:
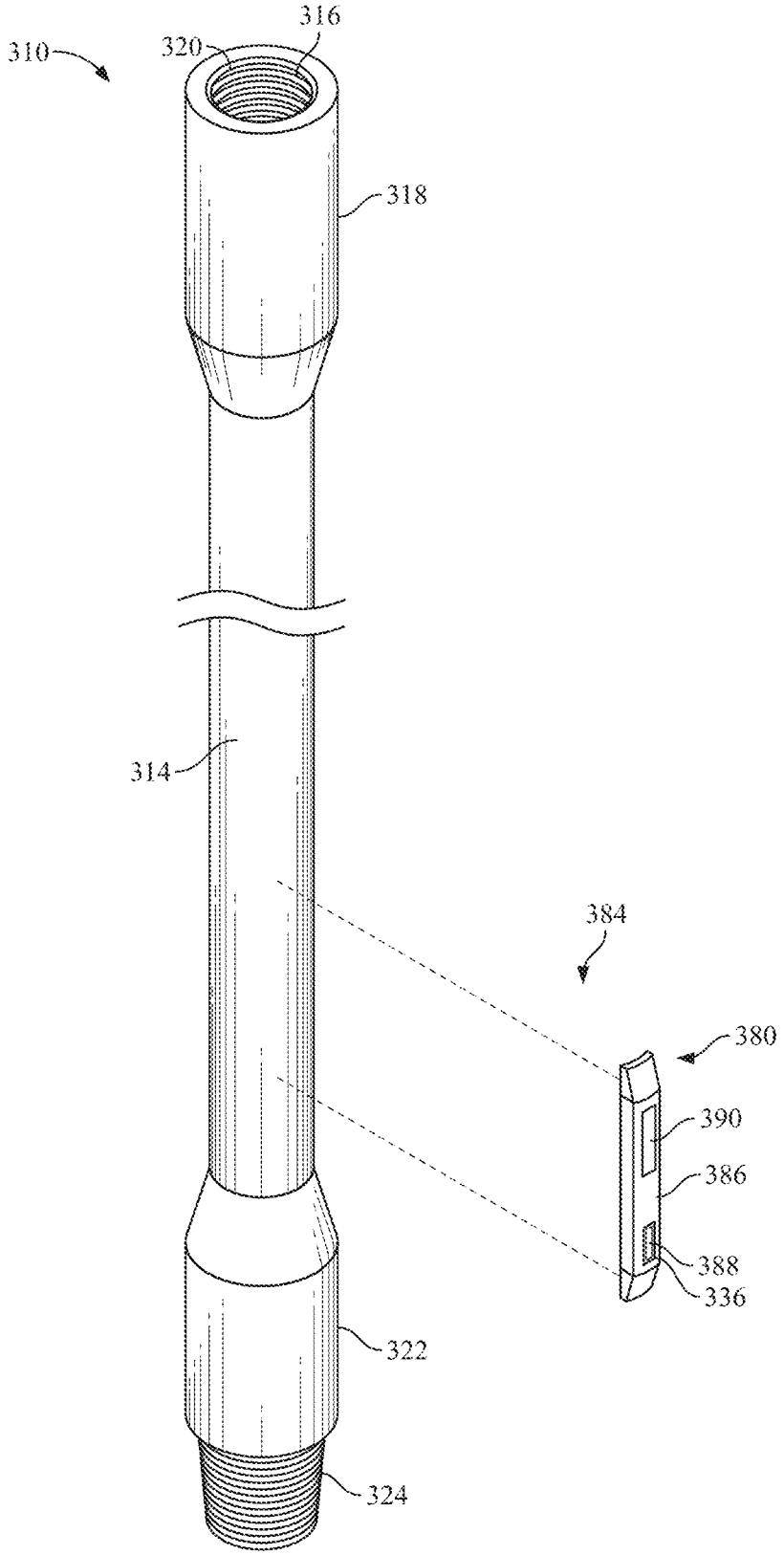
FIG. 3 presents a perspective view of an illustrative tubular section of a downhole wireless telemetry system, in accordance with an embodiment of the disclosure. An intermediate communications node in accordance herewith, is shown in exploded form away from the tubular section.

Referring now to FIG. 3, an enlarged perspective view of an illustrative tubular section 310 of a tubular body, along with an illustrative intermediate communications node 380 is shown. In this view, the illustration depicts a drill pipe tubular, but it is recognized that the components of this disclosure may be provided on casing, pipelines, pigs, tubing strings, coil tubing, or on a conveyable or removable tool, such as a logging tool, drilling tool, plug, packer, gravel packing assembly, production assembly, stimulation tools, or other downhole elongate tool. The illustrative intermediate communications node 380 is shown exploded away 384 from the tubular section 310. The tubular section 310 has an elongated wall 314 defining an internal bore 316. The tubular section 310 has a box end 318 having internal threads 320, and a pin end 322 having external threads 324.

As noted, the illustrative intermediate communications node 380 is shown exploded away from the tubular section 310. The intermediate communications node 380 is structured and arranged to attach to the wall 314 of the tubular section 310 at a selected location. In one aspect, selected tubular sections 310 will each have an intermediate communications node 380 between the box end 318 and the pin end 322. In one arrangement, the intermediate communications node 380 is placed anywhere along wall 314 but typically not immediately adjacent the box end 318 or, alternatively, not immediately adjacent the pin end 322 of every tubular section 310. In another arrangement, the intermediate communications node 380 is placed at a distance-selected location, such as along every second or every third tubular section 310. In some circumstances, intermediate node spacing may even be greater than two or three tubular joints. In other aspects, more or less than one intermediate communications node 380 may be placed per tubular section 310.

In some embodiments, the intermediate communications node 380 shown in FIG. 3 is designed to be pre-welded onto the wall 314 of the tubular section 310. In some embodiments, intermediate communications node 380 is configured to be selectively attachable to/detachable from a tubular by mechanical means at a well 100, 200 (see FIGS. 1-2). This may be done, for example, through the use of clamps, brackets, welding, bonding, provided in a collar or designated joint. An epoxy or other suitable acoustic couplant may be used for chemical bonding. In any instance, the intermediate communications node 310 is an independent wireless communications device that is designed to be attached to an external surface of a tubular.

There are benefits to the use of an externally-placed communications node that uses acoustic waves. For example, such a node will not interfere with the flow of fluids within the internal bore 316 of the tubular section 310. Further, installation and mechanical attachment can be readily assessed or adjusted, as necessary.

As shown in FIG. 3, the intermediate communications node 380 includes a housing 386 for at least a portion of the electronics, such as circuit boards, processors, memory modules, etc. The housing 386 supports a power source residing within the housing 386, which may be one or more batteries, as shown schematically at 390. The housing 386 also supports a first electro-acoustic transducer, configured to serve as a receiver of acoustic signals and shown schematically at 388, a second electro-acoustic transducer, configured to serve as a transmitter of acoustic signals and shown schematically at 336. There is also a circuit board that will preferably include a micro-processor or electronics module that processes acoustic signals, but is not shown in this view.

The intermediate communications node 380 is intended to represent the plurality of intermediate communications nodes 180 of FIG. 1, in one embodiment, and the plurality of intermediate communications nodes 280 of FIG. 2, in another embodiment. The first and second electro-acoustic transducers 388 and 336 in each intermediate communications node 380 allow acoustic signals to be sent from node-to-node, either up the wellbore or down the wellbore. Where the tubular section 310 is formed of carbon steel, such as a casing or liner, the housing 386 may be fabricated from carbon steel. This metallurgical match avoids galvanic corrosion at the coupling.

Figure 4:
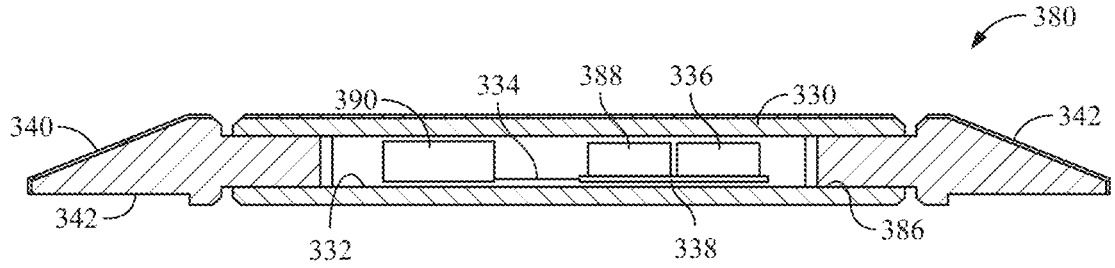
FIG. 4 presents a cross-sectional view of the intermediate communications node of FIG. 3. The view is taken along the longitudinal axis of the intermediate communications node.

Exemplary FIG. 4 provides a cross-sectional view of the intermediate communications node 380 of exemplary FIG. 3. The view is taken along the longitudinal axis of the intermediate communications node 380. The housing 386 is dimensioned to be strong enough to protect internal electronics. In one aspect, the housing 386 has an outer wall 330 that may be about 0.2 inches (0.51 cm) in thickness. A cavity 332 houses the electronics, including, by way of example and not of limitation, a battery 390, a power supply wire 334, a first electro-acoustic transducer 388, configured to serve as a receiver of acoustic signals, and a second electro-acoustic transducer 336, configured to serve as a transmitter of acoustic signals, and a circuit board 338. The circuit board 338 will preferably include a micro-processor or electronics module that processes acoustic signals. The first electro-acoustic receiver transducer 388 is provided to convert acoustical energy to electrical energy, and the second electro-acoustic transmit transducer 336 is provided to convert electrical energy to acoustical energy. Both are acoustically coupled with outer wall 330 on the side attached to the tubular body. The transmit and receive functions of these transducers are optimized for their own purpose and are not considered interchangeable in this disclosure.

In some embodiments, the second electro-acoustic transducer 336, configured to serve as a transmitter, of intermediate communications nodes 380 may also produce acoustic telemetry signals. In some embodiments, an electrical signal is delivered to the second electro-acoustic transducer 336, such as through a driver circuit. In some embodiments, the acoustic waves represent asynchronous packets of information comprising a plurality of separate tones.

In some embodiments, the acoustic telemetry data transfer is accomplished using multiple frequency shift keying (MFSK). Any extraneous noise in the signal is moderated by using well-known analog and/or digital signal processing methods. This noise removal and signal enhancement may involve conveying the acoustic signal through a signal conditioning circuit using, for example, a bandpass filter.

The signal generated by the second electro-acoustic transducer 336 then passes through the housing 386 to the tubular body 310, and propagates along the tubular body 310 to other intermediate communications nodes 380. In one aspect, the acoustic signal is generated by a different communications node via second electro-acoustic transducer 336 and received by the first electro-acoustic receiver transducer 388 in a different node. The transmitter and receiver transducers within the same node do not typically communicate directly acoustically with each other. Electronic circuits are provided within a node to connect the common transducers and receivers within a node. A processor within the node provides this electrical interface to continue the telemetry communication from the node's receiver, through the node to the transmitter transducer, and acoustic transmission onward from the node. In some embodiments, the electro-acoustic transducers 336 and 388 may be magnetostrictive transducers comprising a coil wrapped around a core. In another aspect, the acoustic signal may be generated and/or received by a piezoelectric ceramic transducers. In either case, the electrically encoded data are transformed into a sonic wave that is carried through the wall 314 of the tubular body 310 in the wellbore.

In some embodiments, the internal components of intermediate communications nodes 380 may also be provided with a protective outer layer 340. The protective outer layer 340 encapsulates the electronics circuit board 338, the cable 334, the battery 390, and transducers 336 and 388. This protective layer may provide additional mechanical durability and moisture isolation. The intermediate communications nodes 380 may also be fluid sealed with the housing 386 to protect the internal electronics from exposure to undesirable fluids and/or to maintain dielectric integrity within the voids of a housing. Another form of protection for the internal components is available using a potting material, typically but not necessarily in combination with an outer protective housing, such as a steel housing.

In some embodiments, the intermediate communications nodes 380 may also optionally include a shoe 342. More specifically, the intermediate communications nodes 380 may include a pair of shoes 342 disposed at opposing ends of the wall 330. Each of the shoes 342 provides a beveled face that helps prevent the node 380 from hanging up on an external tubular body or the surrounding earth formation, as the case may be, during run-in or pull-out. The shoes 342 may also have an optional friction reducing coating, a hardbanding coating, or a cushioning material (not shown) as an outer layer 340 for protecting against sharp impacts and friction with the borehole to protect housing internal components from damage. In some embodiments, such as where the housing is flush mounted or counter sunk or otherwise protectively enclosed, the beveled shoes 342 may not be necessary, although in the illustrated embodiments, the shoes also serve to provide a solid attachment and contact interface for acoustic signal transfer between the tubular and the housing.

Figure 5:
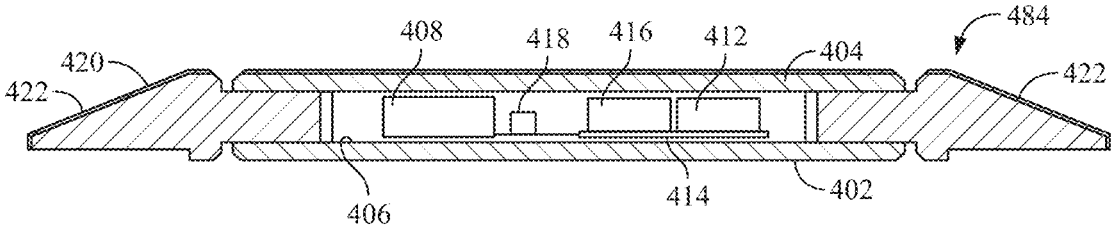
FIG. 5 is a cross-sectional view of an illustrative embodiment of a sensor communications node having a sensor positioned within the sensor communications node. The view is taken along the longitudinal axis of the sensor communications node.

FIG. 5 provides a cross-sectional view of an exemplary sensor communications node 484. The sensor communications node 484 is intended to represent the sensor communications node 184 of FIG. 1, in one embodiment, and the sensor communications nodes 284 of FIG. 2, in another embodiment. The view is taken along the longitudinal axis of the sensor communications node 484. The sensor communications node 484 includes a housing 402. The housing 402 is structured and arranged to be attached to an outer wall of a tubular section, such as the tubular section 310 of FIG. 3. Where the tubular section is formed of a carbon steel, such as a casing or liner, the housing 402 is preferably fabricated from carbon steel. This metallurgical match avoids galvanic corrosion at the coupling.

The housing 402 is dimensioned to be strong enough to protect internal electronics. In one aspect, the housing 402 has an outer wall 404 that may be about 0.2 inches (0.51 cm) in thickness. A cavity 406 houses the electronics, including, by way of example and not of limitation, a battery 408, a power supply wire 410, two transducers 412 and 416, and a circuit board 414. The circuit board 414 will preferably include a micro-processor or electronics module that processes acoustic signals for both transmission and reception. An electro-acoustic transducer 416 is provided as the receiver to convert acoustical energy to electrical energy and is coupled with outer wall 404 on the side attached to the tubular body. An electro-acoustic transducer 412 is used as the transmitter to convert electrical energy to acoustical energy. The transducers 412 and 416 are in electrical communication via circuit board 414 with at least one sensor 418, which may be the at least one sensor 174 of FIG. 1, in one embodiment. It is noted that in FIG. 5, at least one sensor 418 resides within the housing 402 of the sensor communications node 484.

Figure 6:
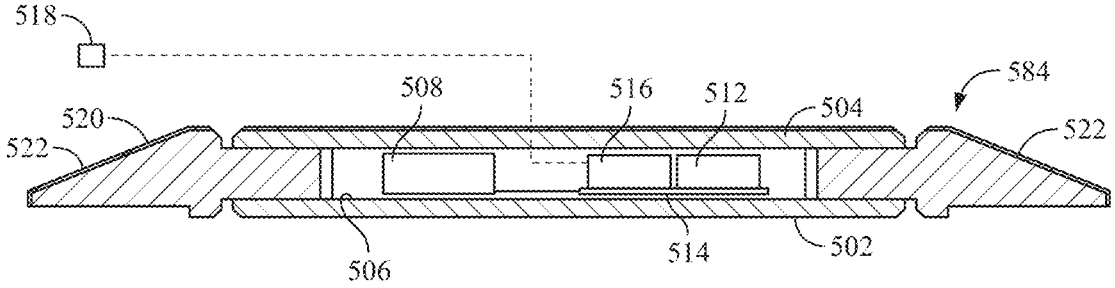
FIG. 6 is another cross-sectional view of an illustrative embodiment of a sensor communications node having a sensor positioned along the wellbore external to the sensor communications node. The view is again taken along the longitudinal axis of the sensor communications node.

Referring now to FIG. 6, an embodiment is presented wherein an at least one sensor 518 is shown to reside external to a sensor communications node 584, such as above or below the sensor communications node 584 along the wellbore. In FIG. 6, the sensor communications node 584 is also intended to represent the sensor communications node 184 of FIG. 1, in one embodiment, and the sensor communications nodes 284 of FIG. 2, in another embodiment. The sensor communications node 584 includes a housing 502, which is structured and arranged to be attached to an outer wall of a tubular section, such as the tubular section 310 of FIG. 3. Shoes 422 and coatings 420 of FIG. 4 and shoes 522 and coatings 520 of FIG. 5, are analogous to shoes 322 and coatings 320 of FIG. 4.

In one aspect, the housing 502 may have an outer wall 504 that may be about 0.2 inches (0.51 cm) in thickness. A cavity 506 houses the electronics, including, by way of example and not of limitation, a battery 508, a power supply wire 510, transducers 512 and 516, a circuit board 514 with processor, memory, and power control components. The circuit board 514 will preferably include a micro-processor or electronics module that processes acoustic signals for both transmission and reception. An electro-acoustic transducer 516 is provided as the receiver to convert acoustical energy to electrical energy and is coupled with outer wall 504 on the side attached to the tubular body. An electro-acoustic transducer 512 is configured as the transmitter to convert electrical energy to acoustical energy. Transducers 512 and 516 are in electrical communication with circuit board 518 and that subsystem is in acoustic communication with at least one sensor 518. A dashed line is provided showing an extended connection between the at least one sensor 518 and the electro-acoustic transducers 512 and 516.

In operation, the sensor communications node 584 is in electrical communication with the (one or more) sensors. This may be by means of a wire, acoustics, or by means of wireless communication such as infrared or radio waves. The sensor communications node 584 may be configured to receive signals from the sensors. In some applications, the sensors may also be configured to transmit signals to an operable or recording device.

The sensor communications node 584 transmits signals from the sensors as acoustic waves. The acoustic waves can be at a frequency band of for example, from about 50 kHz to about 500 kHz, from about 50 kHz to about 300 kHz, from about 60 kHz to about 200 kHz, from about 65 kHz to about 175 kHz, from about 70 kHz to about 160 kHz, from about 75 kHz to about 150 kHz, from about 80 kHz to about 140 kHz, from about 85 kHz to about 135 kHz, from about 90 kHz to about 130 kHz, or from about 100 kHz to about 125 kHz, or about 100 kHz. The signals are received by an intermediate communications node, such as intermediate communications node 380 of FIG. 4. That intermediate communications node 380, in turn, will relay the signal on to another intermediate communications node so that acoustic waves indicative of the downhole condition are sent from node-to-node. A last intermediate communications node 380 transmits the signals to the topside node, such as topside node 182 of FIG. 1, or topside node 282 of FIG. 2.

As indicated above, for downhole intermediate communications transmission, it has been determined that the herein described dual transducer design principles described herein provide improved performance as compared to single transducer communications systems. Most preferred intermediate communications nodes, such as described herein, are of a dual transducer design. A generally preferential design comprises two transducers associated with a housing or communication node: one serving as a transmitter and another serving as a receiver. Acoustic transmission performance optimization may be achieved by a combination of: 1) customizing the electrical impedance matching to the specific transducer; 2) geometric and material selection of the transducer to maximize the desired acoustic qualities; and/or 3) optimized pre-tensioning (pre-loading) of each individual transducer for the expected transmission frequency band.

It will be understood that the one transducer serving as a transmitter may actually comprise multiple transmitter transducers at a single node, such as in a set of transducers serving in that capacity. Similarly, the one transducer serving as a receiver may actually include a set of multiple receivers at a node. However, for simplicity and efficiency, a dual transducer design utilizing a single transducer may be preferred for each of the transmitting and receiving functions at a node. The dual transducer design provides optimal overall performance as an intermediate communication node and through individual optimization offers extended effective acoustic transmission range, although a single electronic board may be used to operate both the transmitter and receiver, separate electronic circuits for each may be desired to separately optimize the performance of each of transmission and receiving respectively. Nonetheless, in some embodiments, some of the electrical components may be shared or used for both transmit and receive functions, where such shared use significantly improves overall efficiency and does not overly sub-optimize either of the transmitter or receiver transducer performance.

In addition to improved communication performance, the dual transducer design may provide such advanced benefits as: a) the transmitter and receiver may be designed and used as a pair of active sensing devices for measurement of physical parameters of interest, such as material surrounding the node, flow velocity, casing corrosion, or the like; b) the transmitter and receiver pair may be designed and used to provide advanced diagnostic information for the communication sensor node itself.

Figure 7A:
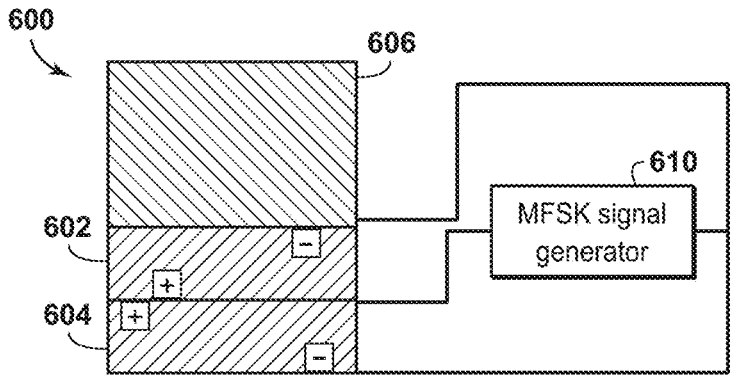
FIG. 7A is a schematic view of a transmitter having multiple-disks for use in an intermediate communications node according to the present disclosure.

Referring now to FIG. 7A, the piezoelectric transmitter 600 may be designed to have multiple disks, 602, 604, . . . , with electrodes connected in parallel, as shown by the "+" and "−" signs indicating relative polarity. A single voltage may be applied equally to all disks 602, 604, . . . . Based on piezotransducer theory, the mechanical vibration output of such a multi disk stack is given by summation of the output of each disk, 602, 604, . . . . The amplitude of vibration displacement of each disk is approximately given by:

$$Y_{disk}=d_p V_{t0}$$

where $d_p$ is the piezo charge constant. The total amplitude of the displacement of parallel multi-disk stack is approximately:

$$Y_{total}=nY_{disk}=n\ d_p V_{t0}$$

where n is the number of disks. Clearly, the mechanical output of the piezo stack can be increased by increasing the number of disks while applying the same voltage. For the same output required, more disks allow using a lower driving voltage from MFSK generator 610.

Figure 7B:
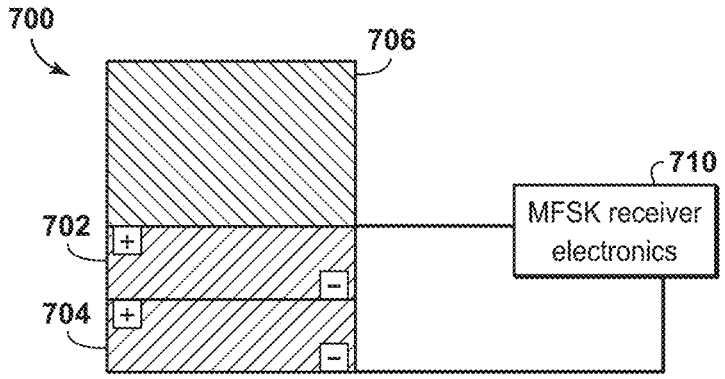
FIG. 7B is a schematic view of a receiver having multiple-disks for use in an intermediate communications node, according to the present disclosure.

Referring now to FIG. 7B, the receiver 700 is designed to have multiple-disks 702, 704, . . . , with electrodes connected in series or a single thicker disk. The voltage output of a single disk of thickness h, when subjected to a vibration force with an amplitude, $F_0$, is given approximately by the following relation:

$$V_{disk}=g_p h\ F_0/A$$

where $g_p$ is the piezo voltage constant, and A is the disk surface. The overall voltage output of a series of multiple disks is approximately:

$$V_{r0}=m\ V_{disk}=m\ g_p h\ F_0/A$$

where m is the number of disks. In theory, a thick disk with thickness of L=m h will perform equally well as multiple disks in series. Therefore, we could increase the thickness of a single disk or number of disks of the same thickness to boost the receiver voltage output. With higher voltage output at a given vibration signal, the receiver 710 sensitivity increases, which will improve detection accuracy or increase the communication range.

In some piezoelectric embodiments, the transmit and/or receive transducer stacks may be fitted with an end mass 606 and/or 706, respectively, to enhance transmission output or receiver sensitivity. The end mass(es) may assist to properly time reflections, enhance amplitude properties, to improve the piezo performance. With separate transmit and receive transducers, the end mass lengths can be individually selected to optimize overall acoustic performance. For example, it may be desired to increase the overall bandwidth for the telemetry frequencies. The end mass lengths may be designed to operate off of or to reduce or enhance the resonance piezoelectric disk resonance frequencies. For further example, the transmit end mass length may be reduced to slightly increase the resonance frequency and the receiver end mass length can be increased to slightly decrease the resonance frequency. Additional performance customization may be achieved with combined collective adjustments to both the electrical impedance matching circuits and the end mass adjustments. With separate transmit and receive transducers, four independent adjustments are available compared to just two with a single transmit/receive transducer. Performance parameters such as power consumption, signal to noise ratio, and bandwidth may be adjusted to improve telemetry and battery life.

In some embodiments, the electronic circuit for the transmitter 600 (FIG. 7*a*) and for the receiver 700 (FIG. 7*b*) are configured as distinct or separate entities to enable individual performance optimization. For example, different amount or a separately adjustable amount of inductance could be applied for each of the transmitter 600 and receiver 700. Cross-talk and receiver noise may also be reduced. Laboratory testing has demonstrated significant operational benefits or improvement with the dual transducer designs such as discussed and disclosed herein over a typical single transducer design, some benefits being as much as 20 dB or better. However, it is recognized that there may be other benefits to using a single transducer design that make such embodiments sometimes preferable or operationally superior or desirable in some applications. The suggested dual transmitter design operational superiority is merely based upon comparing a dual transducer design as described herein with a single transducer design, such as depicted in FIG. 7*a*, for a variety of downhole acoustic telemetry purposes as described generally herein. Many of the identified dual transmitter attributes benefits may be attributable to sensitivity and noise benefits achieved at the receiver that were achievable by optimizing the piezoelectric stack, utilizing end masses, and/or pre-tensioning. Still additional improvements may be obtained by electrical circuit impedance matching, utilizing a determined electronics arrangement, and/or through the use of separate receive and transmit circuitry.

FIGS. 7*a* and 7*b* respectively illustrate end masses 606 and 706. The end mass may typically have a length that provides constructive interference with the excitation at the operating frequency or at frequencies other than the operating frequency, as desired. The acoustic reflection at the opposite end of the mass including the polarity inversion associated with the reflection will result in a constructive summation at the operating face of the stack with the next cycle of excitation. The exemplary embodiment includes an end mass on both the transmitting and receiving transducers.

In an exemplary embodiment, the end mass and stack are pre-tensioned (pre-loaded or pre-stressed, or pre-strained). In the illustrated embodiment, the stack is pre-tensioned to the housing. Pre-tensioning may also be done to the tubular. Pre-tensioning may provide multiple benefits or options, such as for example, the output of the transmit stack may be enhanced receiver sensitivity may be increased mechanical durability may be improved, and/or long term device performance may be more stable.

Figure 8B:
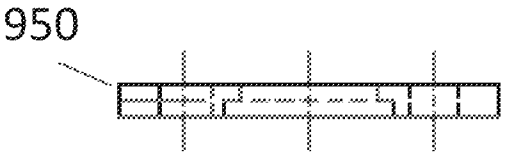
FIG. 8B illustrates a top and side view of a pre-tensioning support plate for use with a stepped end mass and piezo stack, according to the present disclosure. This piezo stack can be either a transmitter or a receiver.
Figure 8B:
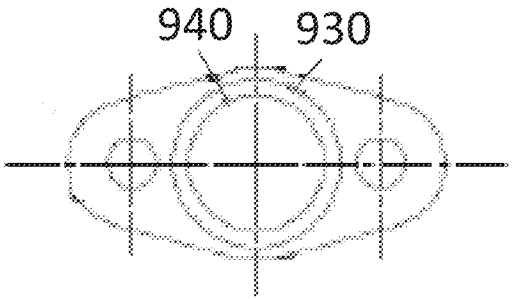
Figure 8A:
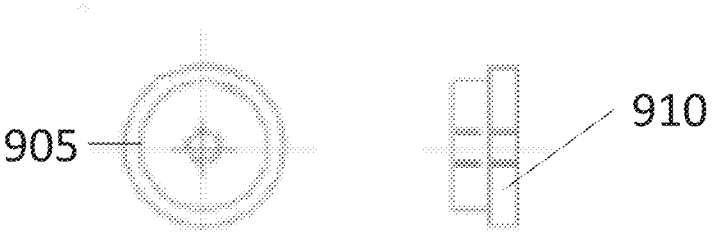
FIG. 8A illustrates a top and side view of a stepped piezo stack end mass for use with a pre-tensioning plate, according to the present disclosure. This piezo stack can be either a transmitter or a receiver.

As depicted in FIG. 8*a*, in an exemplary embodiment, the illustrated end mass 900 is fabricated with a lip 905 to facilitate centering the pretensioning support plate 920 about the end mass. The larger diameter section 910 of end mass 900 is the face that becomes attached to the piezo. The diameters 930 and 940 of pretensioning support plate 920 shown in FIG. 8*b* are sized to fit squarely over end mass lip 905. Thickness 950 and diameter 930 of pre-tensioning support plate 920 constrain the positioning of the end mass 900 and pre-tensioning support plate 920.

Figure 9B:
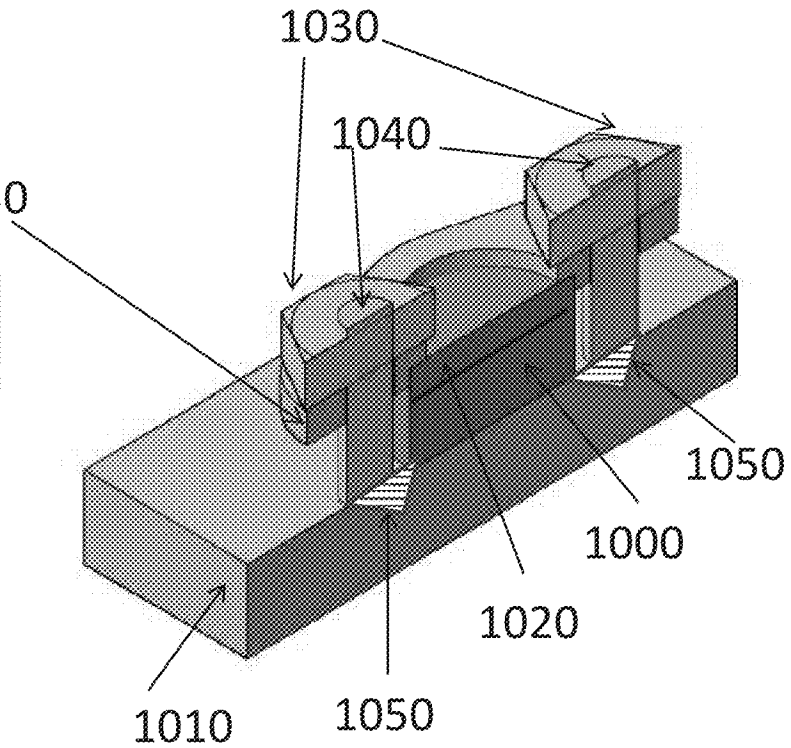
FIG. 9B illustrates a cut-away of a rendering of a piezo stack and connected to its pre-tensioning support plate, according to the present disclosure. This piezo stack can be either a transmitter or a receiver.
Figure 9A:
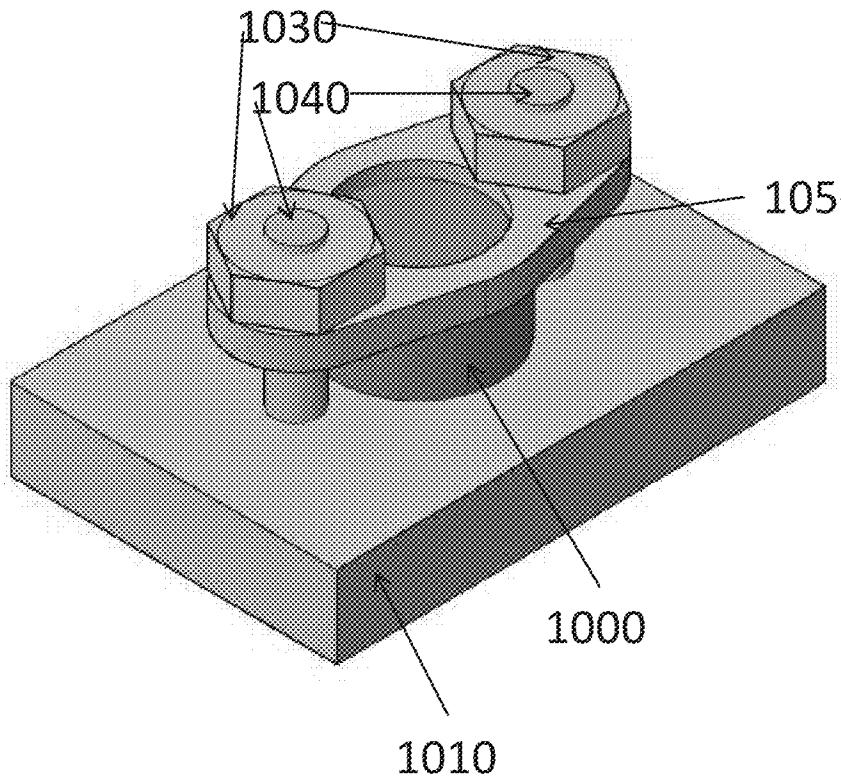
FIG. 9A illustrates a 3-D rendering of a piezo stack and connected to its pre-tensioning support plate, according to the present disclosure. This piezo stack can be either a transmitter or a receiver.

FIGS. 9*a* and 9*b* depict an embodiment for how the piezo stack 1000 and end mass 1020 may be pre-tensioned to housing 1010. The housing cut-away 1010 represents a small portion of the housing 386 in FIG. 4 or 402 shown in FIG. 5. FIG. 9*b* illustrates the explicit separation between piezo stack 1000 and end mass 1020. In an exemplary embodiment, the end mass and piezo stack are acoustically coupled with an epoxy or glue. The end mass and piezo stack can be preassembled prior to installation on the housing. The piezo stack and end mass are pre-tensioned to the housing with pre-tensioning support plate 1050 using threaded rods 1040 and secured with nuts 1030. In an exemplary embodiment, the gluing attachment to the housing cures with the completed pre-tensioning. The glue between the piezo stacks and housing may include material to facilitate electrical conductivity.

As presented in FIGS. 9*a* and 9*b*, the installation of pre-tensioning support plate 1050, threaded rods 1040 and 1030 would electrically connect the top and bottom electrodes of piezo stack 1000 if all parts were electrically conductive. As shown in FIG. 7*a*, that connection may be desirable in the case of a two-disk transmitting piezo stack. However, in the situation of the receiver piezo stack shown in FIG. 7*b*, that connection would create a short circuit and would be undesirable. Several options are available to isolate that connection. One approach is to use non-conductive rods 1040. Another approach is to use conductive rods 1040 but to use non-conductive sleeves around those rods to prevent contact with the pre-tensioning support plate 1050. Yet another approach is to incorporate a non-conductive washer between the top of end mass 1020 and the pre-tensioning support plate 1050.

Figure 10A:
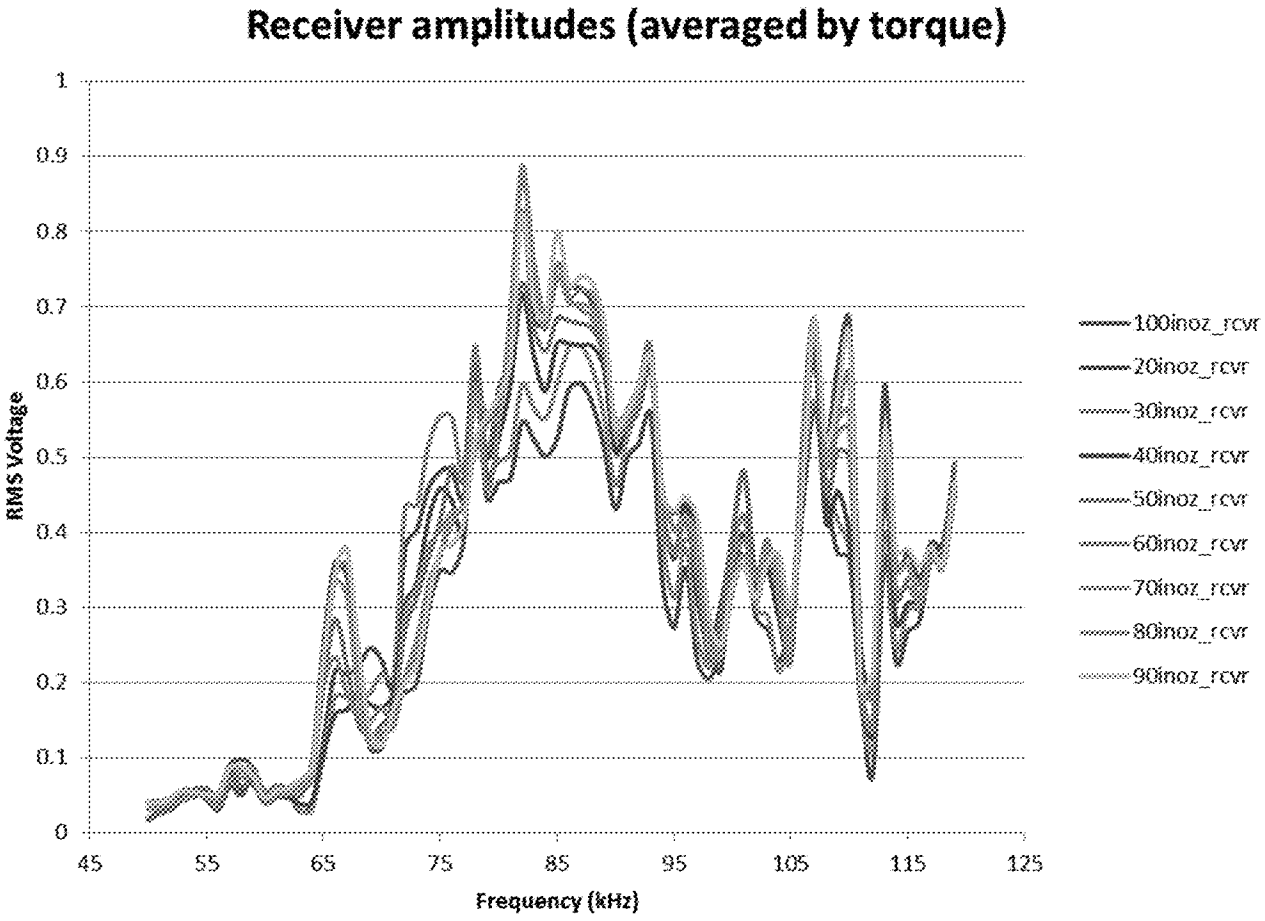
FIG. 10A presents a receiver response as a function of frequency and amount of pre-tensioning torque.
Figure 10B:
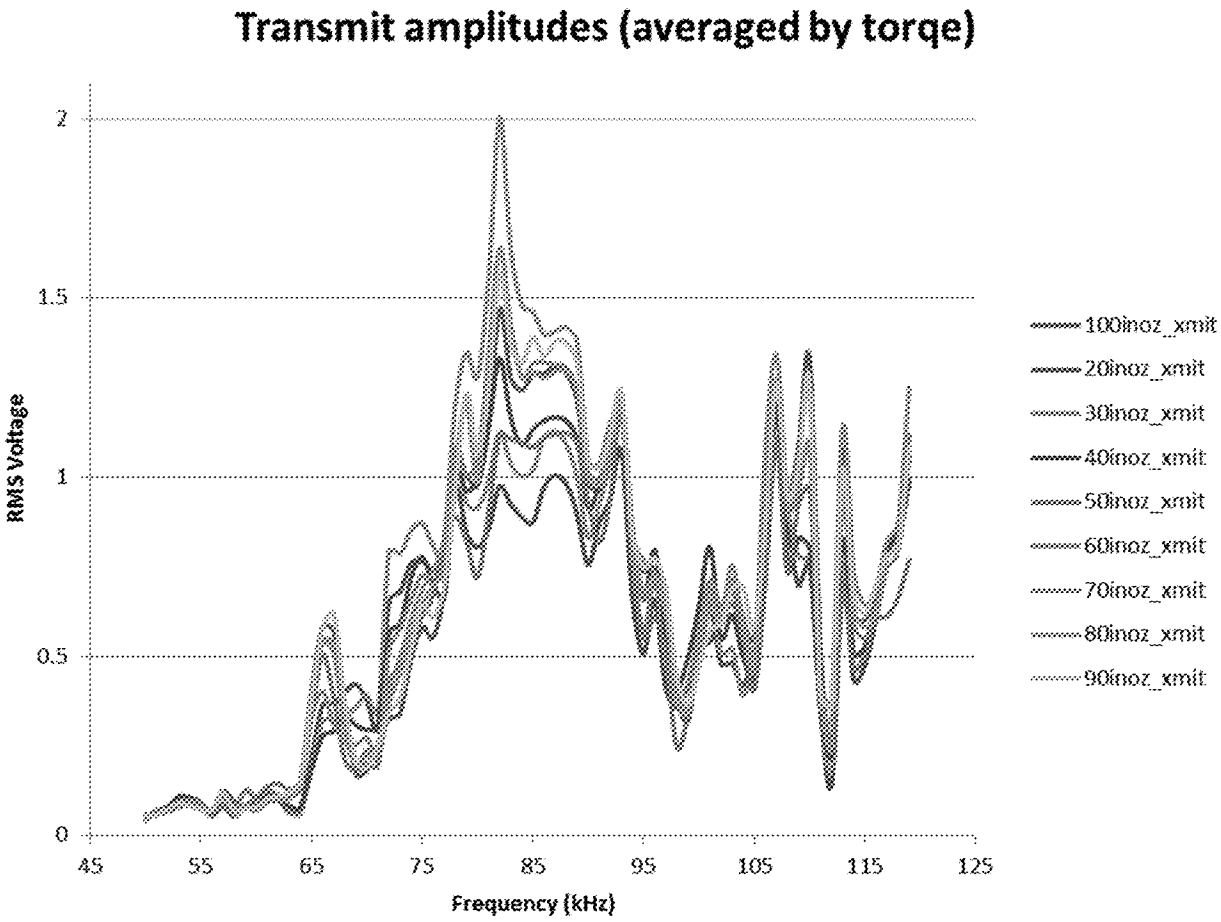
FIG. 10B presents an exemplary transmitter response as a function of frequency and amount of pre-tensioning torque, according to the present disclosure.
Figure 10C:
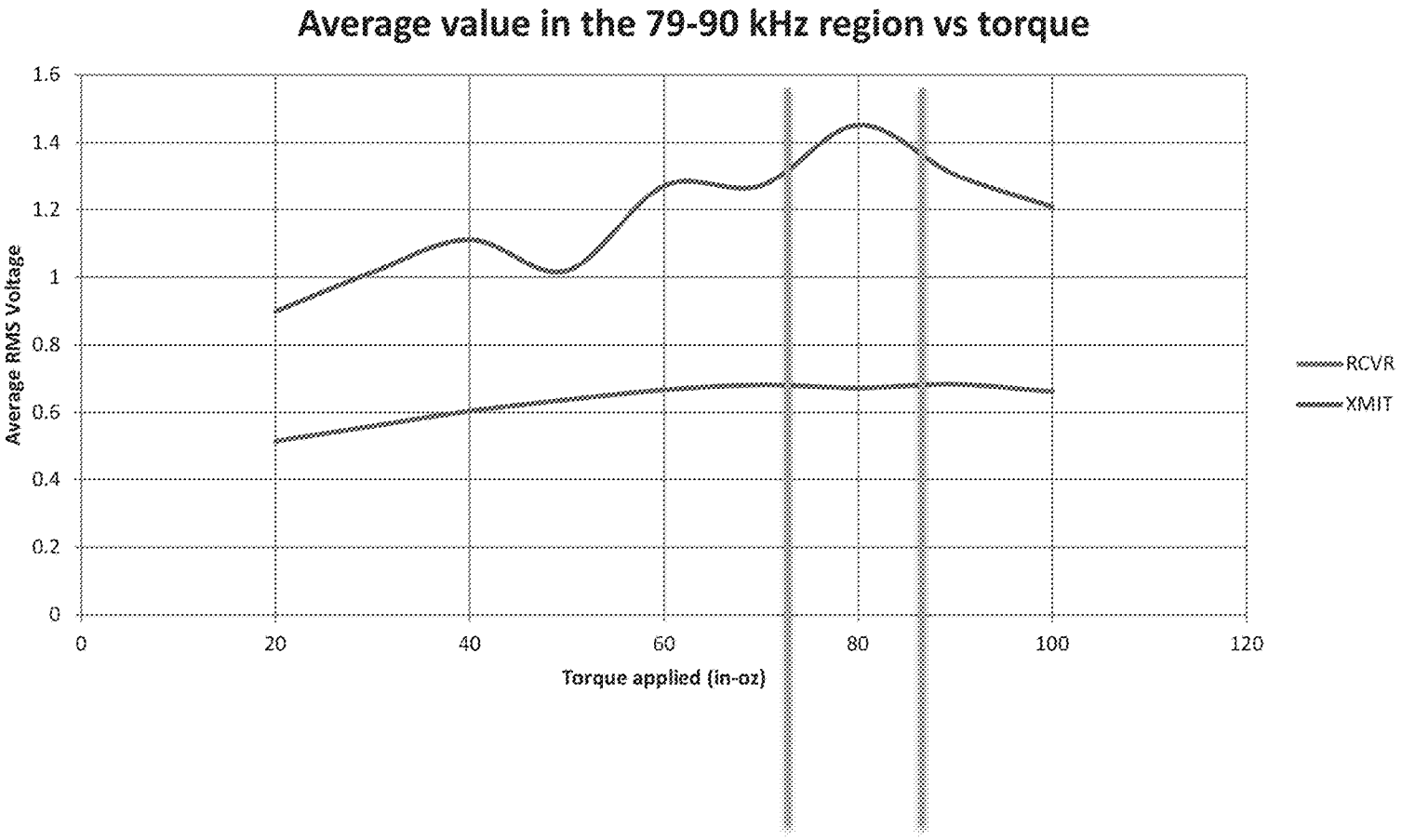
FIG. 10C presents an frequency response in the 79-90 kHz range of a transmitter and receiver piezo stacks as a function of pre-tensioning torque, according to the present disclosure.

As shown in FIGS. 10*a* and 10*b*, the tested range of pre-tensioning torque is 20-100 inch-ounces. Each graphed line represents a different re-tensioning torque. Separate tests have been conducted on the receiving (FIG. 10*a*) and transmitting (FIG. 10*b*) piezo stacks, utilizing progressively increasing torque. The distinction in graphed lines in those figures generally illustrates that transmit and receive performance may be optimized for a pre-tensioning torque in a range greater than the beginning torque values but less than the ending torque values, with the optimal ranges illustrated in the torque range where the graphed amplitude is at its highest range, such as for example in the 70-90 inch-ounce range. The data in FIG. 10*c* presents another embodiment illustration of this result for operation in the 79-90 kHz frequency band. As is typical when torqueing with multiple connections, each nut 1030 is sequentially tightened to apply the required torque step-wise.

Testing has demonstrated considerable mechanical durability utilizing the pre-tensioning arrangement illustrated in FIGS. 9*a/b* at a pre-tension torque of 90-inch ounces. With the devices clamped to a tubular, no performance was observed for either the transmit and receive piezo stacks after repeated drops from approximately a 3 feet height.

Figure 11:
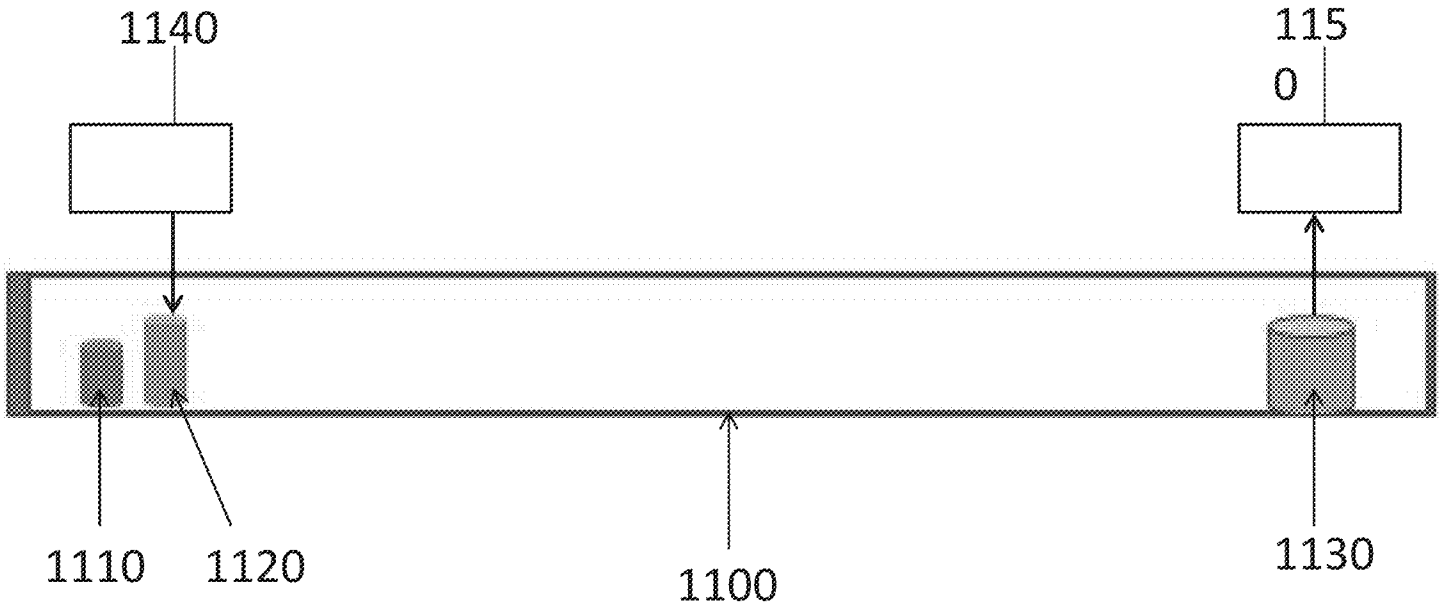
FIG. 11 illustrates a layout of equipment for assessing piezo stack attachments to the housing, according to the present disclosure.

In an exemplary embodiment, the assembly fabrication confirms that piezo stacks with end mass, batteries, and electronics are each functioning according to specification prior to installation in the node housing. For example, piezo stacks can be tested for impedance and Dp (piezo charge constant). A critical fabrication step is the attachment of the piezo stack to the housing. Although the pre-tensioning mechanism described in FIGS. 9*a/b* reduces attachment variability, the epoxy mix, surface preparation, and surface flatness are all sources that can degrade acoustic performance and consequently reduce manufacturing yield. In an exemplary embodiment, the attachment of both piezo stacks are tested to confirm suitable performance. FIG. 11 illustrates an arrangement using a transducer of known quality. Housing 1100 in FIG. 11 is a representation of the housing 386 in FIG. 4 or 402 shown in FIG. 5. Two separate tests were conducted: one for a transmit piezo stack and one for a receiver piezo stack. To test the transmit stack, an electrical excitation via generator/exciter 1140 is applied to transmit stack 1110 and measuring reception via a volt meter or oscilloscope 1150 through the transducer of known quality 1130. To test receiver stack 1120, an electrical excitation is applied to the transducer of known quality 1130 and measuring reception at receiver stack 1120. Devices 1140 and 1150 are connected, respectively, to the transducer of known quality 1130 and to receiver stack 1120.

Typically, the same physical device can be used as the transducer of known quality for the transmitting and receiving tests. In an exemplary embodiment, a specific position for the attachment of the transducer of known quality 1130 is established on housing 1100. The temporary attachment to the housing is achieved with a spring clamp or similar device and includes the application of a consistent acoustic couplant. The transmitting and receiving tests can be conducted without removing transducer 1130. Several repeated tests with removal and reattachment of transducer 1130 on the same housing establish an experimental repeatability band. Repeating this sort of testing on several housings establishes an overall experimental and hardware range for the results. Since the nature of this testing is to assess the quality of the acoustic attachment of transducer stacks 1110 and 1120 to the housing, the amplitude of the frequency response is the primary parameter of interest.

Figure 12:
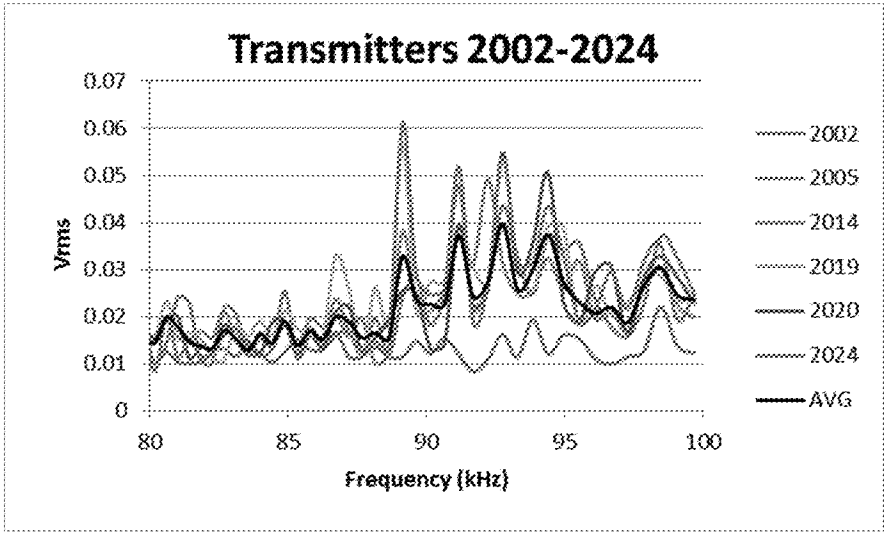
FIG. 12 illustrates an example of an underperforming transmitting piezo stack attached to a housing, according to the present disclosure.

There is no unique methodology for determining the acceptance, rejection, and baseline criteria. In an exemplary embodiment, the excitation test frequencies from device 1140 are coincident with the anticipated telemetry frequencies. The repeated testing methodology is adequate to determine piezo stacks that have a defective bond. FIG. 12 demonstrates the situation where several transmit piezo stacks had been installed in designated housings, demonstrating that the response from the piezo stack installed in housing 2002 is operationally deficient as compared to the others. The average response shown in FIG. 12 is based on measurements from eleven piezoelectric transmit stacks installed in eleven different housings spaced evenly apart along a length of a tubular string. Only housing 2002 shows a significant discrepancy compared to the others. In this particular case, all of the piezo stacks shown used to develop the data of FIG. 12 were individually tested prior to attachment in their housings. No significant differences were identified among the stacks prior to their installation in the housings. However, the methodology disclosed herein would have identified a problematic piezo stack without explicit testing prior to installation in the housings. The disclosed methodology would identify an issue with either the piezo stack fabrication and/or its installation in the housing.

It is recognized that although many electro-acoustic transducer embodiments disclosed herein refer to "piezoelectric" type transducers, the electro-acoustic transducers included herein may also or alternatively be other electro-mechanical or electro-kinetic type of electro-acoustic transducers such as magnetostriction, electrostriction, and/or magnetostrictive transducers. These other types of transducers may be suitable in some embodiments and are recognized as included within this disclosure and may also be utilized either in combination with or in substitution for piezoelectric type of transducers (including receive and/or transmit transducers). Similarly, sensors may be utilized with the presently disclosed technology may utilize digital, analog, wireless, optical, thermal, mechanical, electrical, and/or chemical types of sensor technology may be as included herewith to supply data for incorporation into and telemetry by the data telemetry systems as disclosed herein, where they may be transmitted to a process or end-user for collection, further processing, analysis and/or use.

Figure 13:
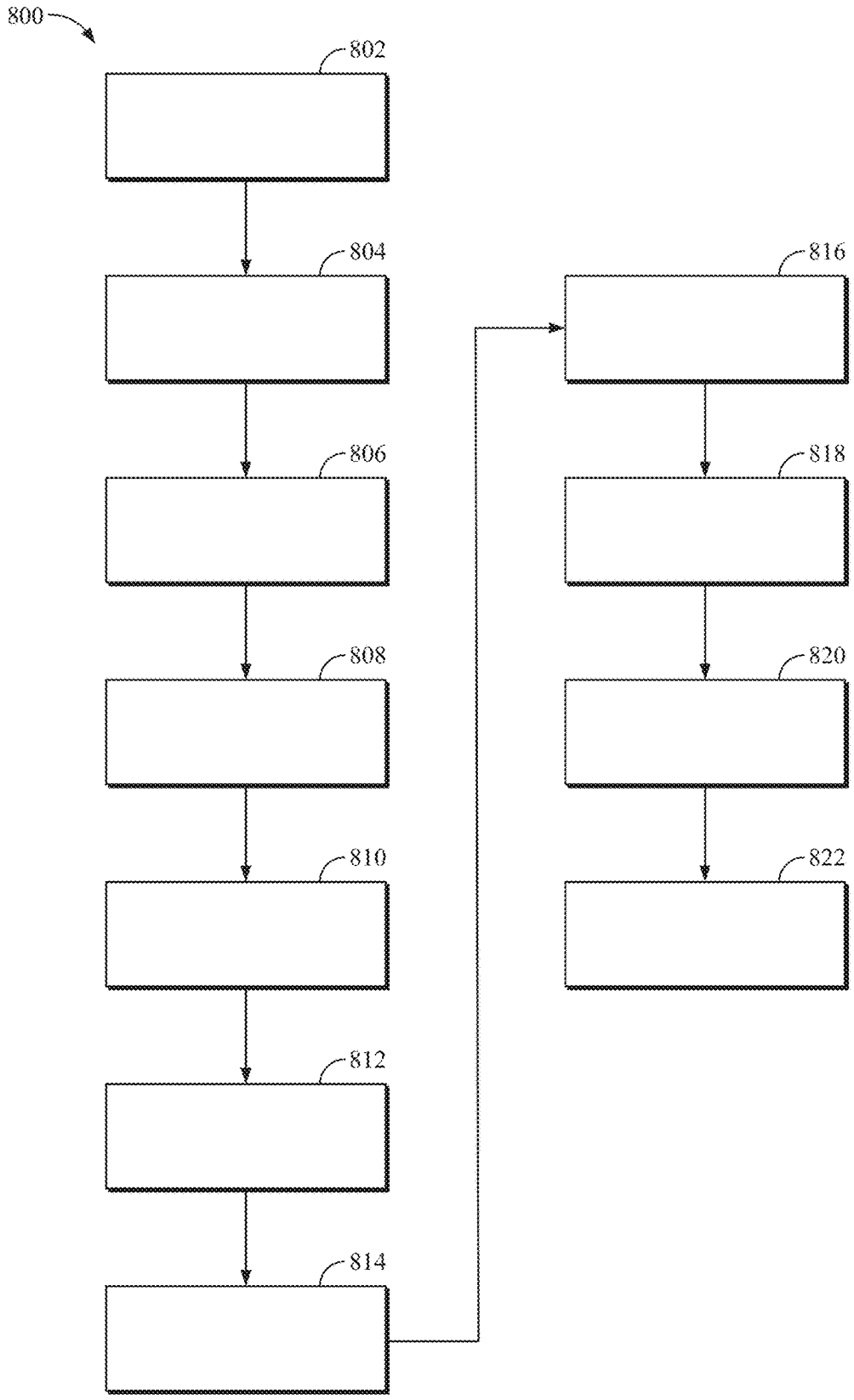
FIG. 13 is a generalized flowchart of an exemplary method of monitoring a hydrocarbon well having a tubular body, in accordance with an embodiment of the disclosure.

Referring now to FIG. 13, also provided is a method 800 of monitoring operations or conditions within a hydrocarbon well having a tubular body, utilizing the disclosed technology. In one aspect, the method 800 includes the steps of: 802, providing one or more sensors positioned along the tubular body; 804, receiving signals from the one or more sensors; 806, transmitting those signals via a sensor transmitter to an electro-acoustic communications node attached to a wall of the tubular body, the electro-acoustic communications node comprising a housing; a piezoelectric receiver positioned within the housing, the receiver transducer structured and arranged to receive acoustic waves that propagate through the tubular member; a transmitter transducer also positioned within or about the housing, the transmitter transducer structured and arranged to transmit acoustic waves through the tubular member; a controller to sequence transmissions and receptions; and a power source comprising one or more batteries positioned within the housing; 808, transmitting signals received by the electro-acoustic communications node to at least one additional electro-acoustic communications node; and 810, transmitting signals received by the at least one additional intermediate communications node to a topside communications node. In some embodiments, the method 800 further includes 814, providing separate electronics circuits to optimize the performance of the piezoelectric receiver and the piezoelectric transmitter.

In some embodiments, the piezoelectric transmitter includes multiple piezoelectric disks, each piezoelectric disk having at least a pair of electrodes connected in parallel with an adjacent piezoelectric disk. In some embodiments, the piezoelectric receiver comprises multiple piezoelectric disks, each piezoelectric disk having at least a pair of electrodes connected in series with an adjacent piezoelectric disk. In some embodiments, the method 800 further includes 816, sending an acoustic signal from the piezoelectric transmitter of the electro-acoustic communications node; and 818, determining from the acoustic response of the piezoelectric receiver of the electro-acoustic communications node a physical parameter of the hydrocarbon well. In some embodiments, the method further includes relaying information 820, this at a different time, and 822, measuring the change in acoustic response to determine whether a physical change in hydrocarbon well conditions has occurred.

In some aspects, the improved technology includes an electro-acoustic communications node for a downhole wireless telemetry system, comprising a housing having a mounting face for mounting to a surface of a tubular body, a receiver transducer positioned within the housing, the transducer receiver structured and arranged to receive acoustic waves that propagate through the tubular member, a transmitter transducer positioned within the housing, the transmitter transducer structured and arranged to retransmit the received acoustic waves through the tubular member to another receiver transducer; and a power source comprising one or more batteries positioned within the housing powering electronics circuits interfaced to the transmitter and receiver transducers. Each communication node includes a transmitter transducer and a receiver transducer. The transducer may be in a common physical housing or in a separate adjacent physical housing, but even if in an adjacent physical housing, the adjacent housings may considered a common housing for purposes herein.

In some embodiments, the transducers may be piezoelectric devices while in other embodiments, the transducers may be magnetostrictive devices, while in still other embodiments the transducers may be a combination of both piezo and magnetostrictive devices.

In some embodiments, the transducers and electronic circuits in a housing may merely repeat the received acoustic waves as acoustically interpreted and then retransmit the received and interpreted waves by the transmitter associated with that housing, much like a common radio repeater transmitter transmits radio waves from one communications tower to another, in series. In other embodiments, the electronic circuits may actually decode the acoustic signal message received by the receiver associated with a housing, for example to determine whether an instruction is included, and then recode the message for retransmission by the transmitter associated with that respective housing to the next receiver or another receiver associated with another housing.

Further illustrative, non-exclusive examples of systems and methods according to the present disclosure are presented in the following enumerated paragraphs. It is within the scope of the present disclosure that an individual step of a method recited herein, including in the following enumerated paragraphs, may additionally or alternatively be referred to as a "step for" performing the recited action.

INDUSTRIAL APPLICABILITY

The apparatus and methods disclosed herein are applicable to the wellbore and pipeline industries, such as but not limited to the oil and gas industry and fluid processing and transmission industries. It is believed that the disclosure and claims set forth herein encompasses multiple distinct inventions with independent utility. While each of these inventions has been disclosed in a generalized or preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

The invention claimed is:

1. An electro-acoustic communications node assembly for a downhole wireless telemetry system, comprising:

a housing having a mounting face for mounting to a surface of a tubular body;

a receiver transducer positioned within the housing, the receiver transducer structured and arranged to receive acoustic waves that propagate through the tubular member, using multiple frequency shift keying (MFSK), in a frequency range between 50 kHz and 120 kHz;

a transmitter transducer positioned within the housing, the transmitter transducer structured and arranged to retransmit the received acoustic waves, using MFSK, in the frequency range, through the tubular member to another receiver transducer;

electronic circuits positioned within the housing for electrically communicating with each of the receiver transducer and the transmitter transducer;

a processor in communication with each of the receiver transducer and transmitter transducer via the electronic circuits; and a power source comprising one or more batteries positioned within the housing for powering the transmitter transducer and the receiver transducer.

2. The assembly of claim 1, wherein at least one of the receiver transducer and the transmitter transducer is one of a piezoelectric device and a magnetorestrictive device.

3. The assembly of claim 2, wherein the piezoelectric transmitter comprises multiple piezoelectric disks, each piezoelectric disk having at least a pair of electrodes connected in parallel with an adjacent piezoelectric disk.

4. The assembly of claim 3, wherein a single voltage is applied equally to each piezoelectric disk.

5. The assembly of claim 3, wherein the mechanical output of the piezoelectric transmitter is increased by increasing the number of disks while applying the same voltage.

6. The assembly of claim 2, wherein the piezoelectric receiver comprises one of multiple piezoelectric disks, each piezoelectric disk having at least a pair of electrodes connected in series with an adjacent piezoelectric disk, or a single piezoelectric disk, the single piezoelectric disk having a thickness equivalent to the total thickness of the multiple piezoelectric disks to achieve the same sensitivity.

7. The assembly of claim 2, wherein at least one of the receiver transducer and the transmitter transducer include an end mass.

8. The assembly of claim 7, wherein the electronics circuits include separate impedance matching for a receiving transducer circuit and a transmitter transducer circuit, and wherein the end mass and electrical impedance matching are collectively selected to optimize telemetry parameter for transmit, receive, and/or energy consumption.

9. The assembly of claim 1, wherein the electronic circuits repeat the received acoustic waves to retransmit the received acoustic waves by the transmitter.

10. The assembly of claim 1, wherein the electronic circuits decode the received acoustic waves and then recode the received acoustic waves to be retransmitted by the transmitter transducer.

11. The assembly of claim 1, wherein the electronics circuit is comprised of two separate electronics circuits to optimize the performance of the receiver transducer and the transmitter transducer.

12. The assembly of claim 1, wherein the electronics circuits include separate impedance matching for a receiving transducer circuit and a transmitter transducer circuit.

13. The assembly of claim 1, wherein the housing includes a first end and a second end, each of which have a clamp associated therewith for clamping to an outer surface of the tubular body.

14. The assembly of claim 1, wherein the receiver transducer receiving the sent acoustic signal is positioned in the same physical housing as the transmitting transducer.

15. The assembly of claim 1, wherein the housing further comprises distinct housings for each of the receiver transducer and the transmitter transducer, and the distinct housings are in electrical communication with the processor via the electronic circuits, and the processor is positioned within at least one of the distinct housings.

16. The assembly of claim 1, wherein the frequency range is between 79 kHz and 90 kHz.

17. A downhole wireless telemetry system, comprising:

at least one sensor disposed along a tubular body;

at least one sensor communications node placed along the tubular body and affixed to a wall of the tubular body, the sensor communications node being in at least one of acoustic and electrical communication with the at least one sensor and configured to receive signals therefrom;

a topside communications node placed proximate a surface;

a plurality of electro-acoustic communications nodes spaced along the tubular body and attached to a wall of the tubular body, each electro-acoustic communications node comprising a housing having a mounting face for mounting to a surface of the tubular body; a receiver transducer positioned within the housing, the receiver transducer structured and arranged to receive acoustic waves that propagate through the tubular member, using multiple frequency shift keying (MFSK), in a frequency range between 50 kHz and 120 kHz; a transmitter transducer positioned within the housing, the transmitter transducer structured and arranged to transmit acoustic waves through the tubular member, using MFSK, in the frequency range between 50 kHz and 120 kHz; and a power source comprising one or more batteries positioned within the housing powering electronics circuits interfaced to the transmitter and receiver transducers;

wherein the electro-acoustic communications nodes are configured to transmit signals received from the at least one sensor communications node to the topside communications node in a substantially node-to-node arrangement.

18. The downhole wireless telemetry system of claim 17, wherein at least one of the receiver transducer and the transmitter transducer is one of a piezoelectric device and a magnetorestrictive device.

19. The downhole wireless telemetry system of claim 18, wherein at least one of a piezoelectric receiver transducer and a piezoelectric transmitter transducer include an end mass.

20. The downhole wireless telemetry system of claim 17, wherein the at least one sensor communications node is configured to transmit signals to the at least one sensor.

21. The downhole wireless telemetry system of claim 17, wherein the electronics circuit comprises separate circuits for each of the transmitter transducer and receiver transducer to separately optimize circuit performance of each of a receiver circuit and a transmitter circuit.

22. The system of claim 17, wherein the frequency range is between 79 kHz and 90 kHz.

23. A method of monitoring a hydrocarbon well having a tubular body comprising:

providing one or more sensors positioned along the tubular body;

receiving signals from the one or more sensors;

transmitting those signals via a sensor transmitter to an electro-acoustic communications node attached to a wall of the tubular body, the electro-acoustic communications node comprising a housing; a receiver transducer positioned within the housing, the receiver transducer structured and arranged to receive acoustic waves that propagate through the tubular member; a transmitter transducer positioned within the housing, the transmitter transducer structured and arranged to transmit acoustic waves through the tubular member; electronics circuits interfaced to the transmitter and receiver transducers; and a power source comprising one or more batteries positioned within the housing;

transmitting signals received by the electro-acoustic communications node to at least one additional electro-acoustic communications node, using multiple frequency shift keying (MFSK), in a frequency range between 50 kHz and 120 kHz; and transmitting, using MFSK, signals received by the at least one additional intermediate communications node, in the frequency range between 50 kHz and 120 kHz to a topside communications node.

24. The method of claim 23, wherein at least one of the transmit transducer and the receive transducer is one of a piezoelectric device and a magnetorestrictive device.

25. The method of claim 23, further comprising:

providing the electronics circuits with separate impedance matching for each transducer; and optimizing an impedance in a receiving transducer circuit with an impedance of a transmitter circuit.

26. The method of claim 23, further comprising:

sending an acoustic signal from the transmitter transducer of the electro-acoustic communications node and receiving the sent acoustic signal at the receiver transducer; and determining from the received acoustic response at the receiver transducer a well parameter of the hydrocarbon well.

27. The method of claim 26, further comprising repeating the method at a different time with respect to a previous time and measuring the change in acoustic response between the previous time and the different time to determine whether a change has occurred in a well parameter.

28. The method of claim 23, wherein the frequency range is between 79 kHz and 90 kHz.

* * * * *